US005281296A

United States Patent [19]

Beliveau

[11] Patent Number: 5,281,296

[45] Date of Patent: Jan. 25, 1994

[54] LABEL APPLICATOR

[75] Inventor: David B. Beliveau, North Swanzey, N.H.

[73] Assignee: Markem Corporation, Keene, N.H.

[21] Appl. No.: 738,238

[22] Filed: Jul. 30, 1991

[51] Int. Cl.[5] ..... B65C 9/00

[52] U.S. Cl. ..... 156/542; 156/364; 156/556; 156/566; 156/DIG. 31

[58] Field of Search ..... 156/285, 277, 361, 364, 156/542, 556, 566, DIG. 31

[56] References Cited

U.S. PATENT DOCUMENTS

| | | | |
|---|---|---|---|
| Re. 24,097 | 11/1955 | Von Hofe | 156/212 |
| Re. 30,419 | 10/1980 | Crankshaw et al. | 156/249 |
| 3,850,774 | 11/1974 | Schonig et al. | 156/455 |
| 3,885,705 | 5/1975 | French | 221/211 |
| 4,046,613 | 9/1977 | Kucheck et al. | 156/249 |
| 4,124,429 | 11/1978 | Crankshaw | 156/364 |
| 4,314,869 | 2/1982 | Crankshaw | 156/560 X |
| 4,323,416 | 4/1982 | Malthouse et al. | 156/521 |
| 4,324,608 | 4/1982 | Klinger | 156/542 X |
| 4,566,933 | 1/1986 | Crankshaw et al. | 156/444 |
| 4,574,027 | 3/1986 | Weinundbrot | 156/352 |
| 4,581,094 | 4/1986 | Sato | 156/556 X |
| 4,680,082 | 7/1987 | Kearney | 156/497 |
| 4,703,923 | 11/1987 | Anderson et al. | 271/3.1 |
| 4,707,211 | 11/1987 | Shibata | 156/354 |
| 4,784,714 | 11/1988 | Shibata | 156/354 |

FOREIGN PATENT DOCUMENTS 0101278 2/1984 European Pat. Off. .

*Primary Examiner*—David A. Simmons
*Assistant Examiner*—James J. Engel, Jr.
*Attorney, Agent, or Firm*—Roylance, Abrams, Berdo & Goodman

[57] ABSTRACT

A label applicator and method for applying labels to an article is provided that changes the orientation of a label from a horizontal to a vertical orientation before the label is applied to the article, so that the label is not applied to the article in the same, or parallel, plane that the label is presented to the applicator. The label applicator includes a housing formed from a first faceplate and a second faceplate, each having a plurality of holes passing therethrough which define an interior chamber adapted to be connected to a source of reduced pressure. The second faceplate extends in a plane that, in the preferred embodiment, is substantially perpendicular to the plane of the first faceplate. A plurality of conveyor belts carried by the housing carry the labels from the first faceplate to the second faceplate. A corner assembly having openings that are larger than the holes of the faceplates interconnects the first and second faceplates.

22 Claims, 19 Drawing Sheets

LABEL APPLICATOR

BACKGROUND OF THE INVENTION

The present invention relates generally to label applicators, and is particularly concerned with a portable-vacuum applicator that receives pressure-sensitive labels in a relative horizontal plane, alters the orientation of the labels to a relative vertical plane, and then applies the labels to desired articles by positive air pressure The terms "horizontal" and "vertical" are used herein to describe planes that are substantially mutually perpendicular to one another. The use of these terms is soley for the purpose of convenience and is not intended to limit the scope of the invention.

Various types of devices that employ positive or negative air pressure, or both, have been proposed for use in applying adhesive-backed labels to cartons, bottles, and similar articles. One such device, employing both positive and negative pressure, consists of a housing having one wall formed with openings or perforations. A system of parallel, spaced-apart endless belts for transporting the labels is coupled to the housing such that the belts pass along the outside of the perforated wall. The housing is substantially sealed except for the perforated wall and is partially evacuated by means of a suitable vacuum source such as a vacuum pump. The negative pressure within the housing draws air in through the openings of the wall, causing labels to be retained on the belts as the belts are driven past the perforated wall. To apply the labels to an article, intermittent bursts of compressed air, sufficient to overcome the label-retaining force of the vacuum, are applied to the labels through selected openings of the perforated wall, thereby blowing the labels onto the article In another arrangement, labels to be applied to an article are carried along a straight path by a perforated endless belt. A vacuum is applied behind the perforated belt in order to hold the labels on the belt as they are transported from a label receiving station to a label applying station. At the label applying station, a vacuum/blower system reverses the air flow through the perforated belt in order to blow other labels onto the articles.

Oftentimes in the label application field, pressure-sensitive labels, once they have been printed, are dispensed from a label printer in a plane which has a generally horizontal orientation. The labels may be presented to a label applying device, such as one of the above-mentioned applicators, for application to an article. In both of the aforementioned label applying devices, however, the labels are presented to and blown from the label applicator substantially in the same plane. That plane is the same in which the label is dispensed, typically a horizontal plane.

The applicator does not change the orientation of the label from this original horizontal plane. Consequently, the surface of the article to which the label is to be applied must be aligned in a horizontal plane that is parallel to the plane in which the label is dispensed in order to insure proper application of the labels to the article. This would typically require conveying the article beneath the label applying device. The particular shape of the article, however, may make it difficult to convey the article beneath the label applying device. For example, often the surface of the article to which a label is to be applied must be arranged in a vertical plane rather than in a horizontal plane due to the article's shape. In such a case, the aforementioned label applying devices could not be used for applying the labels to the article. Instead, it becomes necessary to manually remove the labels from the printer and directly apply them to the article. This process, however, can prove to be cumbersome and time consuming.

SUMMARY OF THE INVENTION

In accordance with the present invention, an improved label applicator is provided that changes the orientation of a label before it is applied to an article so that the label is not applied to the article in the same, or parallel, plane that the label is presented to the applicator. The label applicator includes a housing which defines an interior chamber adapted to be connected to a source of reduced pressure such that a partial vacuum is maintained in the chamber. The housing is formed from a first faceplate and a second faceplate, each having a plurality of holes passing therethrough. Each of the holes forms a passage connecting the chamber to the exterior of the housing. The second faceplate extends in a plane that, in the preferred embodiment, is substantially perpendicular to the plane of the first faceplate. A plurality of conveyor belts carried by the housing carry the labels from the first faceplate to the second faceplate.

A corner assembly interconnects the first and second faceplates. The corner assembly also has a plurality of openings each of which forms a passage connecting the chamber to the exterior of the housing. The openings of the corner assembly, however, are made larger than the holes of the first and second faceplates. The applicator includes at least one conduit that is enclosed in the housing and which has one end adapted to be connected to a source of pressurized gas and the opposite end adapted to be received in one of the holes in the second faceplate. When pressurized gas is delivered to the conduit, it propels the label away from the faceplate.

In accordance with the present invention, a method is also provided for applying labels to an article. The label to be applied to an article is delivered to a first surface and is retained on the first surface by a suction. The label is then transported around a corner, while increasing the suction force. The label is then delivered to a second surface that extends at an angle with respect to the first surface, is retained on the second surface by suction, and subsequently applied to an article.

The suction force is increased around the corner by increasing the total area over which the label is exposed to suction. In addition, the label is applied to the article by delivering pressurized gas to the label to cause the label to be propelled away from the second surface. Sufficient pressurized gas is delivered to the label to overcome the retaining force of the suction.

The apparatus and method of the present invention overcomes the disadvantages presented by the prior art label applying devices by changing the orientation of a label from a horizontal to a vertical position before it is applied to an article. With the present invention, the surface of an article to which a label is to be applied may be aligned in a vertical plane, rather than, necessarily, in a horizontal plane as would be the case if a prior art label applying device was employed. The present invention also ensures that as a label is carried from a horizontal position to a vertical position, it remains securely held on the label applicator.

DETAILED DESCRIPTION OF THE PREFERRED EMBODIMENTS

Figure 1:
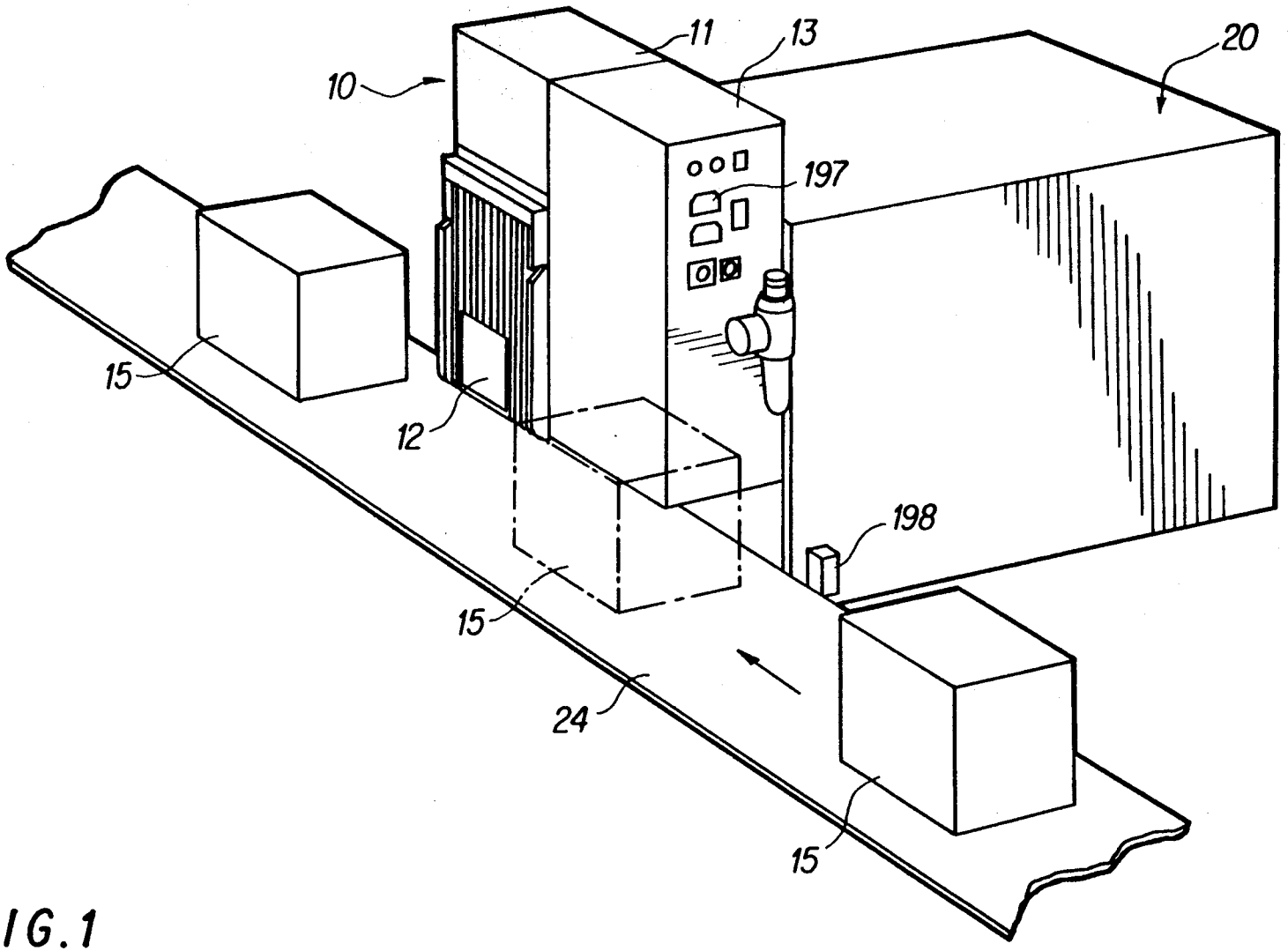
FIG. 1 is a perspective view of a label applicator constructed in accordance with the present invention mounted to a printer in operating position.

FIG. 1 illustrates in operating position a label applicator 10 constructed in accordance with the present invention. The label applicator 10 is shown mounted to a printer 20 that prints and dispenses individual, adhesive-backed labels. In a preferred embodiment of the invention, the label applicator 10 is adapted to be mounted to a model SK-4200 printer, sold by Markem Corporation, of Keene, N.H., or to a Zebra model Z-130 printer, manufactured by Zebra Technologies Corporation of Vernon Hill, Ill. The applicator 10 is a portable, essentially self-contained unit comprising two modules, an applicator module 11 and a control module 13, that are fixedly attached to one another.

The applicator module 11 receives printed labels 12 horizontally from the printer 20, transfers them to a relatively vertical orientation as shown in FIG. 1, and applies the labels 12 to selected articles 15 as the articles 15 are transported past the applicator module 11 by a conveyor system 24. As shown, the articles 15 may be conveyed alongside the applicator 10 and not necessarily beneath it, as would be the case with a conventional label applicator that does not change the orientation of the labels. The control module 13 controls the receipt and delivery of the labels by the applicator module 11.

Figure 2:
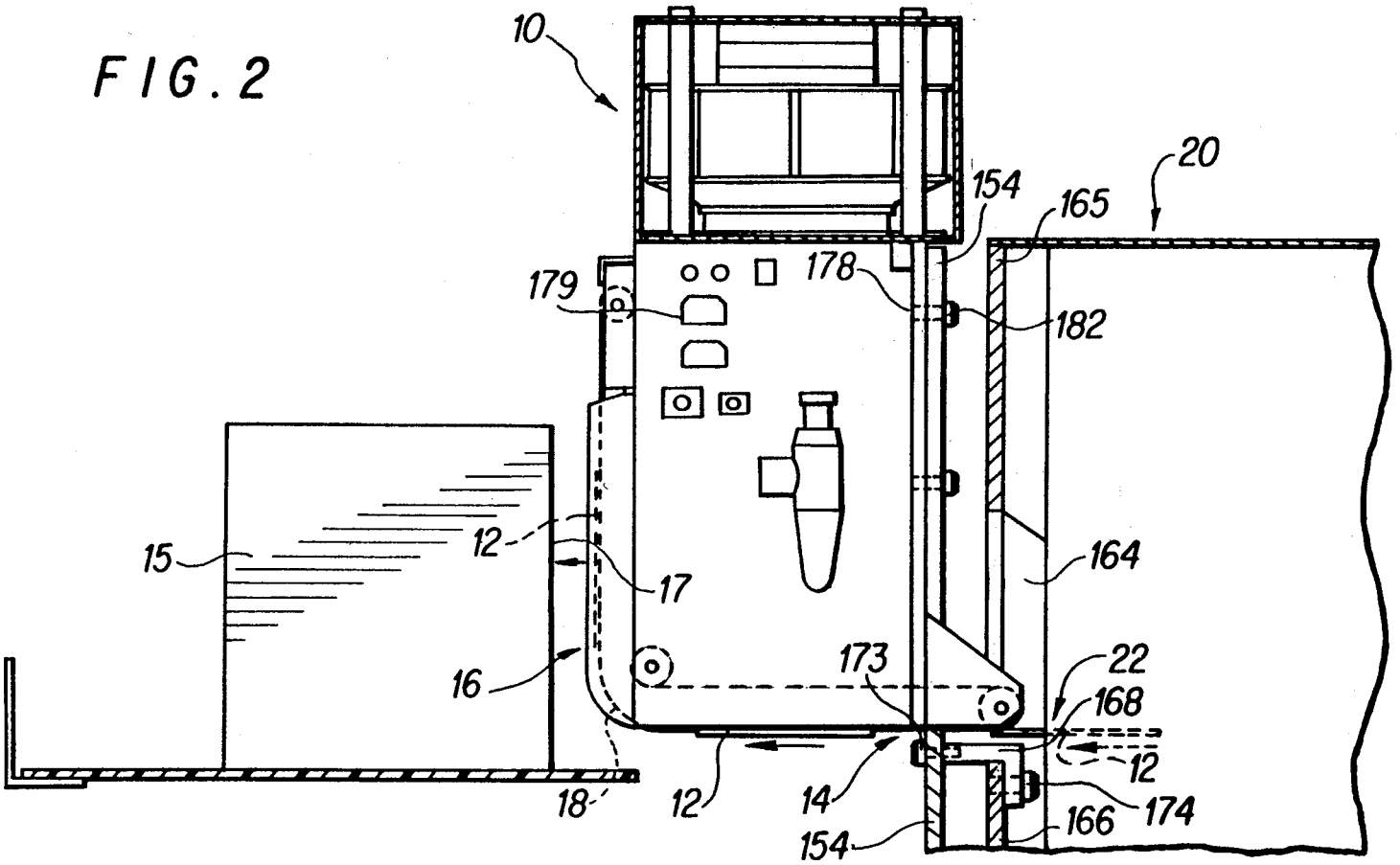
FIG. 2 is a side elevational view of the label applicator mounted to the printer in operating position.

FIG. 2 illustrates a side view of the label applicator 10 mounted to the printer 20 and shows by arrows the path along which the labels 12 travel on the applicator 10. As shown, the printer 20 dispenses the adhesive-backed labels 12 in a substantially horizontal plane, with the adhesive side of the label 12 facing downward. The label applicator 10 receives the labels 12 in the substantially horizontal plane at a label-receiving station 14 and transports the labels 12 through an approximately 90° turn to a label-applying station 16. At the label-applying station 16, the label 12 extends in a generally vertical plane. With this orientation of the label 12, an article 15 can easily be aligned with the applicator 10 so that the surface 17 of the article, to which the label is to be applied, also extends in a generally vertical plane.

A series of substantially parallel, spaced-apart transport belts 18 carry the labels 12 from the label-receiving station 14 to the label-applying station 16. A partial vacuum created within the applicator 10, behind the belts 18, serves to retain the labels on the belts 18. Upon reaching the label-applying station 16, the labels are blown off the belts 18 by a source of pressurized gas and applied to the surface 17 of the article 15.

FIGS. 3-9 illustrate the details of one embodiment of the label applicator 10. The applicator module 11 includes a housing 25 formed from a plurality of walls which define an interior chamber 28. The walls include two faceplates 30 and 32, two side walls 31 and 33, and a rear wall 21. The control module 13 also includes a housing 26 formed from a plurality of walls. The wall 33 serves as a common wall for both the applicator module 11 and the control module 13.

Figure 4:
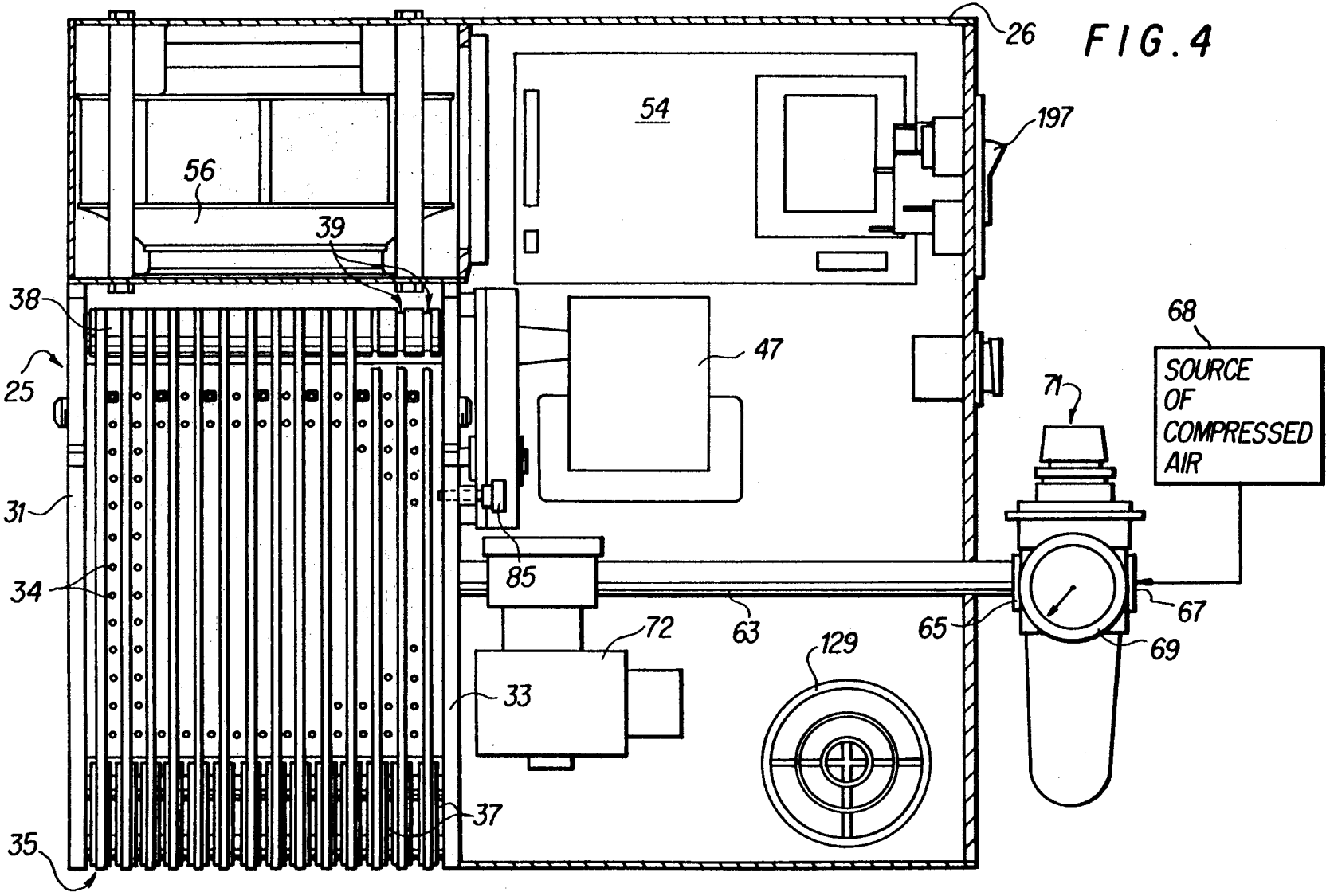
FIG. 4 is a front view of the label applicator of the present invention, illustrating the applicator module and the control module, with the front wall of the control module removed.

Each of the faceplates 30 and 32 of the housing 25 of the applicator module 11 is provided with a plurality of through-holes 34 which communicate between the exterior of the housing 25 and the interior chamber 28. With reference to FIG. 4, the holes 34 are preferably arranged in uniform rows which substantially cover the entire area of the plates 30 and 32. Although only one plate 32 is shown in FIG. 4, substantially the same arrangement of holes 34 is provided for the plate 30. A rounded corner assembly 35 continues the contour of the housing 25 between the two faceplates 30 and 32. The corner assembly 35 has elongated openings or slots 37 communicating between the exterior of the housing 25 and the interior chamber 28.

Figure 3:
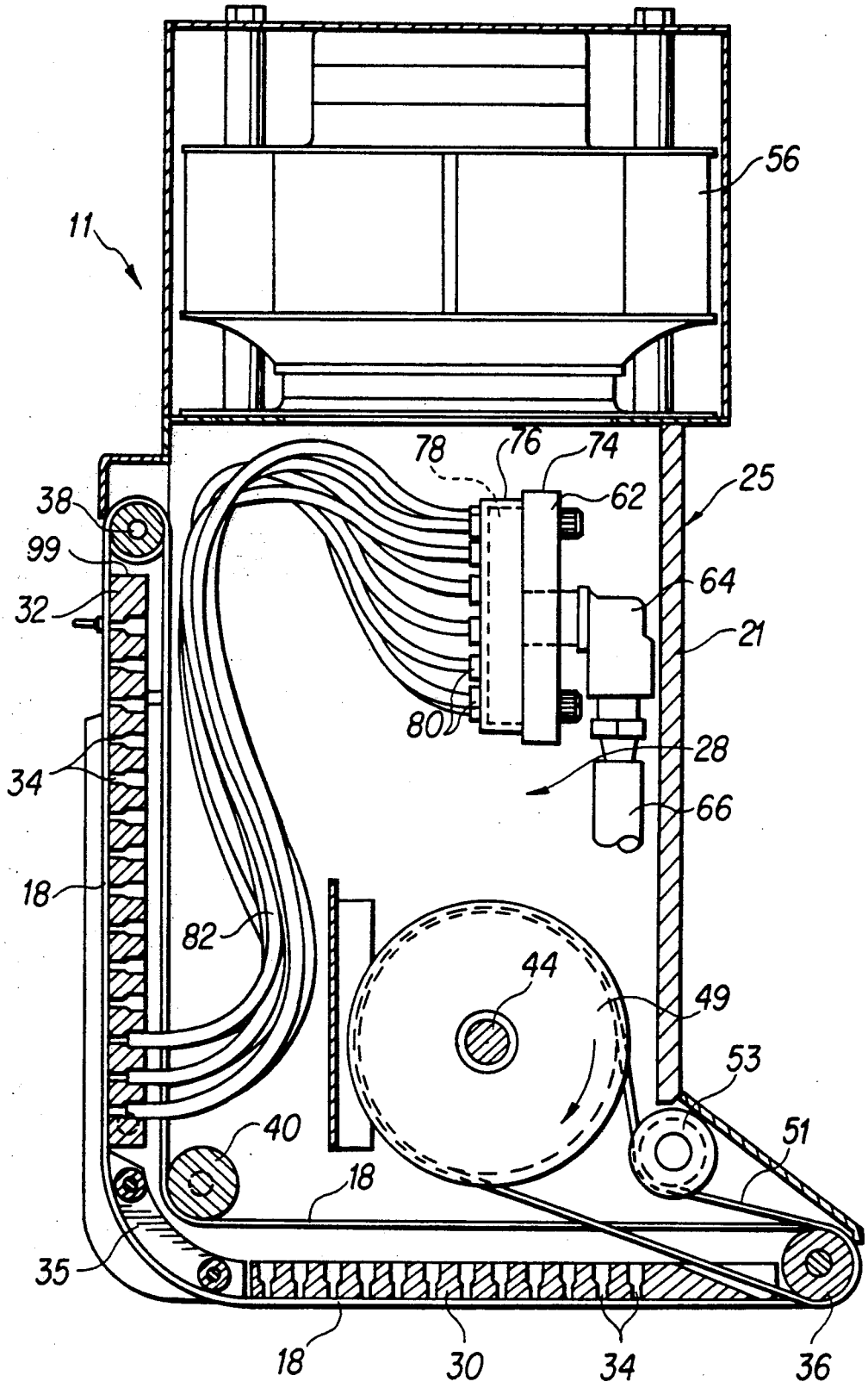
FIG. 3 is a side cross-sectional view of the applicator module used in the label applicator of the present invention.

As shown in FIG. 3, the transport belts 18 are endless belts which are driven past the outer surfaces of the faceplates 30 and 32 and corner assembly 35, around pulleys 36 and 38 located at ends of the faceplates 30 and 32, and through the inner chamber 28. An idler 40 guides the belts through the chamber 28. The pulley 36 is a timing belt pulley that drives the transport belts 18. The drive pulley 36 is coupled by a drive train to a motor 47 that is enclosed in the control module 13 (FIG. 4). The part of the drive train shown in FIG. 3 includes a drive shaft 44 that is fixed to a timing belt pulley 49. The timing belt pulley 49 is in turn drivingly coupled to the drive pulley 36 by a timing belt 51. The drive pulley 36 is provided with a plurality of fine grooves 43 (visible in FIG. 7) circumferentially spaced about the pulley. The grooves 43 allow the pulley 36 to engage the timing belt 51, as well as the transport belts 18.

Advancement of the transport belts 18 is accomplished by energizing the motor 47 to allow the drive shaft 44 to rotate and transmit drive power through the timing belt pulley 49 and timing belt 51, to the drive pulley 36. A tension idler 53 positioned within the chamber 28 helps maintain the tension of the timing belt 51 to avoid slippage which may affect the advancement of the transport belts 18. The drive system is described in more detail below with reference to FIGS. 7 and 8.

The transport belts 18 are preferably a series of generally parallel, fine-tooth timing belts 18 which, as shown in FIG. 4, are spaced apart in such a manner that the belts 18 are positioned between adjacent rows of holes 34 in the plates 30 and 32. The teeth of the belts 18 are configured so that they may engage the grooves 43 of the drive pulley 36. By using timing belts instead of, for example, flat or round belts, the belts will increment by the same amount and speed and will not slip at start-up or when stopped. Such uniform movement of the belts prevents the labels from becoming askew. The end pulley 38 shown in FIG. 4 may be provided with grooves or slots 39, in which the belts 18 may sit, in order to avoid slippage and misalignment of the belts. Preferably, the belts 18 run closely adjacent to the exterior surfaces of the faceplates 30 and 32 and the corner assembly 35 so that the labels 12 may be more securely held thereon when, as explained below, a suction is applied through the openings 34 and 37 of the housing 25.

An exhaust fan 56 is mounted in a hole or cut-out 58 formed in an upper wall of the housing 25 of the applicator module 11. The fan 56 is adapted to be run continuously in order to partially evacuate and thus create a partial vacuum in the interior chamber 28. With its walls in place, the housing 25 is substantially airtight except for the fan opening 58, the holes 34 in the faceplates 30 and 32, and the openings or slots 37 provided in the corner assembly 35. As a result, when the fan 56 is operating, the pressure differential created between the ambient air pressure outside the housing 25 and the reduced or sub-atmospheric pressure within the inner chamber 28 causes air to be drawn past the belts 18 and into the chamber 28. The generated suction serves to retain the labels 12 on the transport belts 18.

When it is desired to apply a label 12 to the surface of an article, a short burst of positive gas pressure is applied to selected ones of the holes 34 of the vertical faceplate 32 in order to overcome the adhesion of the label 12 to the belts 18, caused by the pressure differential, and to forcibly propel the label in the direction of the article. The positive gas pressure is delivered to selected holes 34 by means of an air manifold 62 located within the housing 25 of the applicator module 11 and a series of flexible tubes 82. An air fitting 64 and air hose or conduit 66 couple the manifold 62 to an air line 63 housed within the control module 13, which in turn may be coupled to a source of compressed air 68.

The air manifold 62 consists of a rear section 74 to which the air fitting 64 is attached and a forward section 76 which is formed with a circular cavity 78. The outer surface of the front section 76 carries a plurality of air fittings 80 which communicate with the internal cavity 78. The air fittings 80 are preferably arranged in a circular pattern at the periphery of the cavity 78 and are thus equidistant from the inside opening of the fitting 64, which is at the center of the cavity 78. This arrangement ensures that the flow resistance to each of the fittings 80 is identical and thus provides equal air pressure to each fitting.

The air fittings 80 are connected by lengths of flexible tubing 82 to selected holes of the vertical faceplate 32. The holes 34 have a stepped cross-section so that they are of greater diameter on the inside of the faceplate than on the outside. This permits the ends of the flexible tubes 82 to be received in the interior portions of the holes 34 without extending through the external surface of the faceplates. The flexible tubes 82 are preferably all of the same length in order to equalize the air pressure in each tube. The flexible tubes 82 are preferably connected to the holes 34 of the vertical faceplate 32 in a pattern corresponding to the size and shape of the labels to be applied. To this end, it is preferred that the ends of the tube 82 be releasably connected to the holes 34 so that the tubes may be removed and rearranged in order to suit labels of different shapes and sizes. A greater or lesser number of tubes 82 may be used depending upon the size of the labels to be applied.

With reference to FIG. 4, the air line 63 is preferably a steel conduit that extends across the width of the control module 13. Although the air line 63 is preferably made of steel, any suitable material that is fire proof and sufficiently strong to maintain the integrity of the conduit may be employed. Positioned along the air line 63 is a two-way solenoid valve 72 which controls the release of positive gas pressure to the manifold 62. In a preferred embodiment of the invention, the valve 72 is an ASCO solenoid two-way valve, Part No. 826G208, manufactured by American Solenoid Company of New Brunswick, N.J. The valve 72 allows short, deliberate bursts of pressurized air to be delivered on command when a label is to be blown away from the vertical faceplate 32. Coupled to one end 65 of the air line 63, outside the housing 26 of the control module 13, is a filter and regulator assembly 71 for controlling the pressure of the air delivered to the air line 63 and manifold 62. The assembly 71 includes a pressure gauge 69 for indicating the pressure level of the pressurized gas. The assembly 71 also includes a fitting 67 that may be coupled to a source of compressed air 68. The filter and regulator assembly 71 may be a No. B207-202MIKA model, manufactured by C.A. Norgren Company, Littleton, Co.

Figure 5:
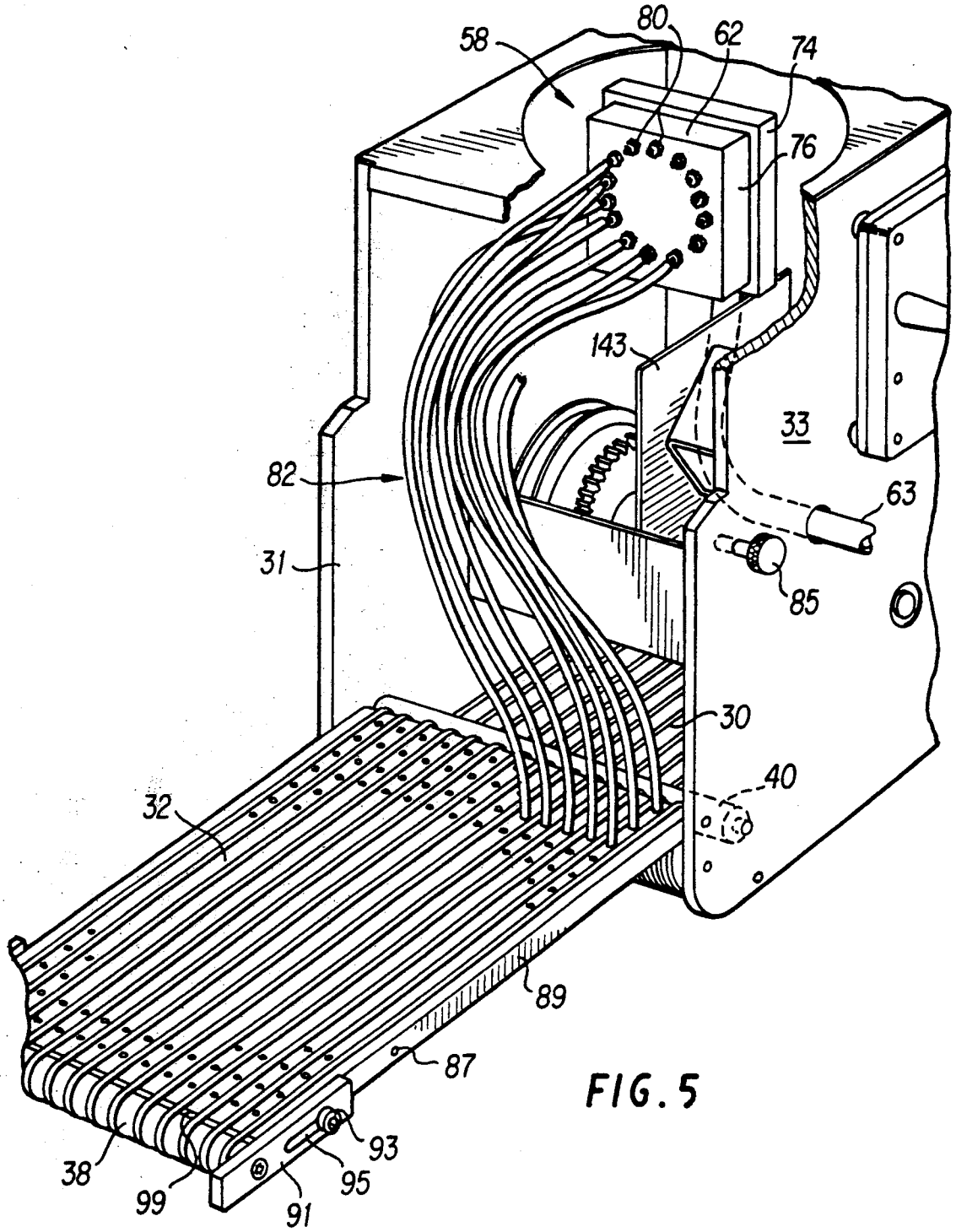
FIG. 5 is a partially cut away perspective view of a portion of the applicator module, with the vertical face plate in a lowered position.

In order to allow convenient access to the interior chamber 28 of the applicator module 11 so that the arrangement of the tube connections to the vertical faceplate 32 may be easily changed and so that maintenance operations may be performed on the interior mechanisms, the vertical faceplate 32 is preferably pivotally mounted to the sidewalls 31 and 33 of the housing 25. With reference to FIGS. 4 and 5, the vertical faceplate 32 is held in an upright, closed position by a conventional screw 85 which engages a detent 87 in a side edge 89 of the faceplate 32. To release the faceplate 32, so that it may be lowered to expose the interior of the housing 25, the screw 85 is rotated using a tool to disengage it from the detent 87.

Extension bar members 91 are provided on either end of the pulley 38 in order to attach the pulley 38 to the vertical faceplate 32. This allows the faceplate 32 and pulley 38 to move as a single unit without significantly disturbing the arrangement of the transport belts 18. The end pulley 38 is pivotally mounted to the extension bar members so that it may rotate with the movement of the belts 18. The extension bars 91 are each fixedly attached to a respective side edge of the vertical faceplate 32 by a bolt 93 which passes through a slot 95 formed lengthwise in the extension bar 91. The distance between the end pulley 38 and the upper edge 99 of the vertical plate 32 may be adjusted by changing the position at which the bolt 93 passes through the slot 95 of the extension bar 91. In this way, the tension of the belts 18 can be modified.

Figure 6:
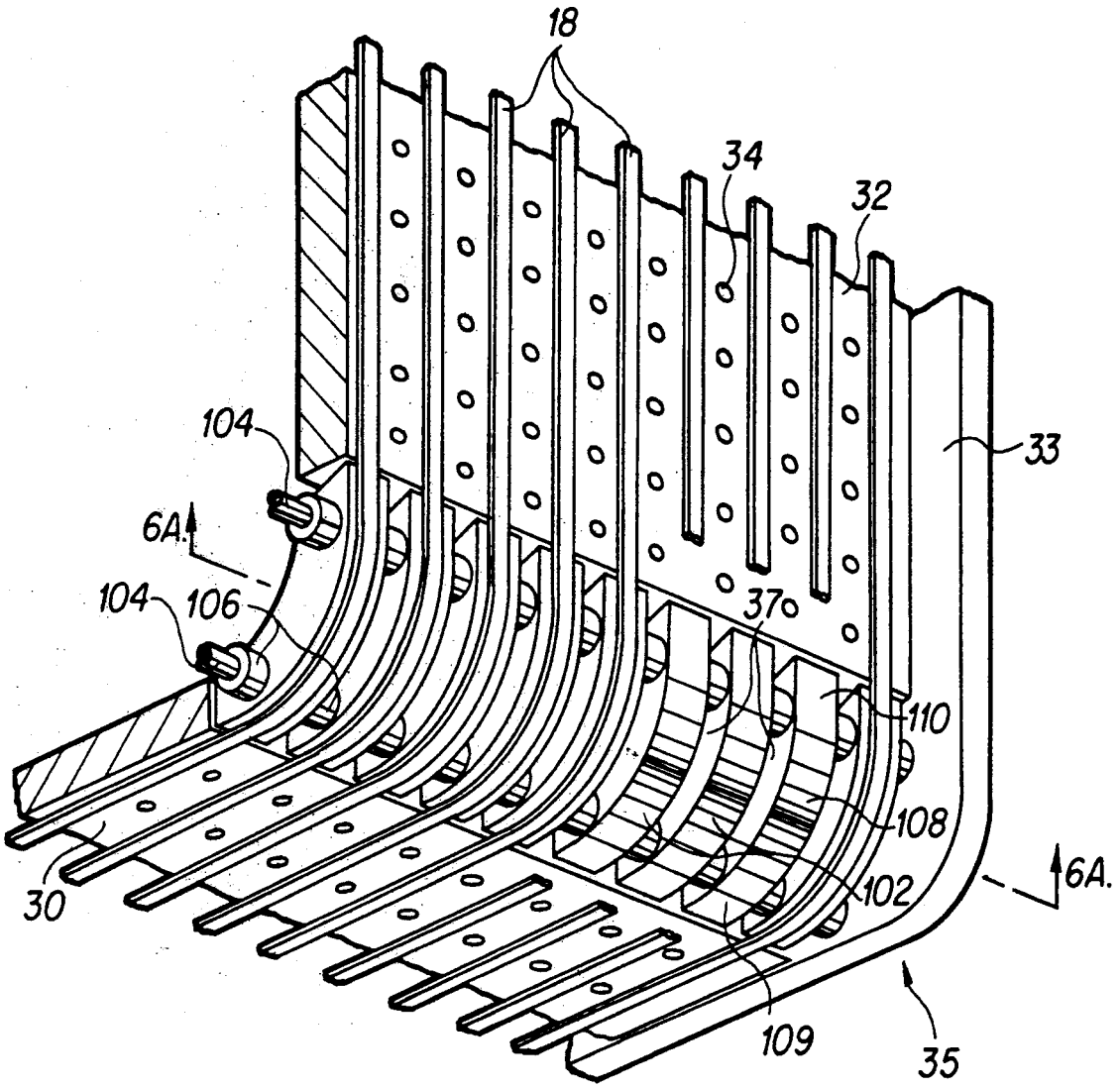
FIG. 6 is an enlarged perspective view of a first embodiment of the corner assembly of the invention.

FIG. 6 illustrates the corner assembly 35 used in the applicator module 11. The assembly 35 comprises a plurality of arcuate corner segments 102 that are mounted to substantially parallel rods 104 which in turn are fixedly secured to the side walls 31 and 33 of the housing 25. Spacers 106 are positioned between adjacent corner segments 102 in order to hold the pieces in parallel, spaced-apart relation such that slots 37 are formed therebetween. The corner segments 102 each have an outer surface 108 which curves through an arc having one end 109 tangent to the outer surface of the faceplate 30 and the other end 110 tangent to the outer surface of faceplate 32. As many corner segments 102 are provided as there are transport belts 18. The belts 18 wrap around the outer surfaces 108 of the corner segments 102.

The corner segments 102 may be made from a plastic material, such as nylon or an acetal resin, or from a metal. In any case, the surfaces 108 of the corner segments 102 preferably have a low coefficient of friction so that the timing belts 18 may easily slide thereover. If the corner segments 102 are made from metal, the outer surfaces 108 can be coated with Teflon to achieve a low coefficient of friction. Similarly, the outer surfaces of the plates 30 and 32 can be coated with Teflon so that the belts 18 can easily slide thereover.

In order to more efficiently retain the labels 12 on the transport belts 18 as the labels 12 round the corner assembly 35, the slots or openings 37 of the assembly 35 are of a larger size than the holes 34 in the faceplates 30 and 32. The natural stiffness of the label 12 tends to bias the label into a substantially flat configuration. Consequently, increased suction must be generated at the corner assembly 35 in order to overcome this natural tendency and cause the label to bend around the corner. The slots 37 provide the necessary suction without the need for a stronger exhaust fan 56.

The amount of air required to be evacuated by the fan 56, and, consequently, the power consumption of the fan, can be kept to a minimum by minimizing the rate at which the air is drawn into the chamber 25 This rate is typically expressed in cubic feet of air per minute (cfm). In general, the lower the rate of air flow into the chamber, the higher the static pressure will be within the chamber 25, i.e., the stronger will be the vacuum produced in the chamber 25. One way to reduce the rate of air flow is to reduce the size of the openings through which the air is drawn into the chamber. Accordingly, it is preferable that the total area of the holes 34 in the faceplates 30 and 32 and of the openings 37 in the corner assembly 35 be as small as possible, yet still provide sufficient exposure of the labels to the partial vacuum produced in the chamber 25 so that the labels 12 may be firmly held to the transport belts 18. As discussed above, however, the labels 12 would require more exposure to the partial vacuum as they are transported around the corner assembly 35 then is necessary when they are being carried along the faceplates 30 and 32. By making the openings 37 of the corner assembly larger, the labels are exposed to the partial vacuum over a greater area. The openings 37 define an area that is larger than that defined by the holes 34 of the faceplates 30 and 32 for a given label area. The leading edge of the label, therefore, is continuously exposed to the partial vacuum as the label is transported around the corner assembly and consequently is continuously forced inwardly so that it follows the contour of the exterior surfaces 108 of the corner assembly. It is desirable that the leading edge of the label 12 be continuously bent inwardly so that the label does not return to its natural flat configuration and, as a result, become disengaged from the corner assembly 35.

Figure 6A:
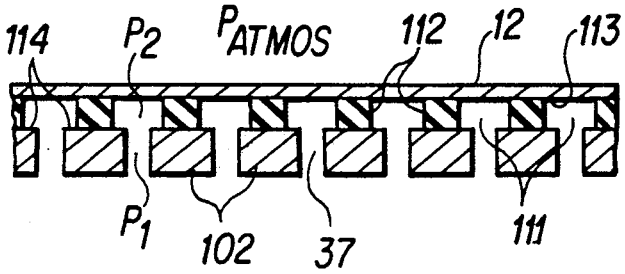
FIG. 6A is a cross-sectional view of the corner assembly taken along the line 6A—6A in FIG. 6.

The arcuate configuration of the corner assembly 35 allows the labels to be subjected to a vacuum over a substantial area. With reference to FIG. 6A, the label 12, as it rounds the corner, forms chambers 111 which have a reduced pressure $P_2$. The chambers 111 are defined by the side edges 112 of adjacent transport belts 18, the inwardly-facing surface 113 of the label 12, and the exposed portions 114 of the outer surfaces 108. The pressure developed in the chamber 111 is less than $P_{ATMOS}$ (the atmospheric pressure on the opposite side of the label 12), yet is greater than the negative pressure $P_1$ created within the applicator housing. Therefore, a slightly weaker suction force is directly applied to the label 12. This suction force, however, is applied over a greater area, thereby, exposing a greater area of the label 12 to the suction.

Figure 7:
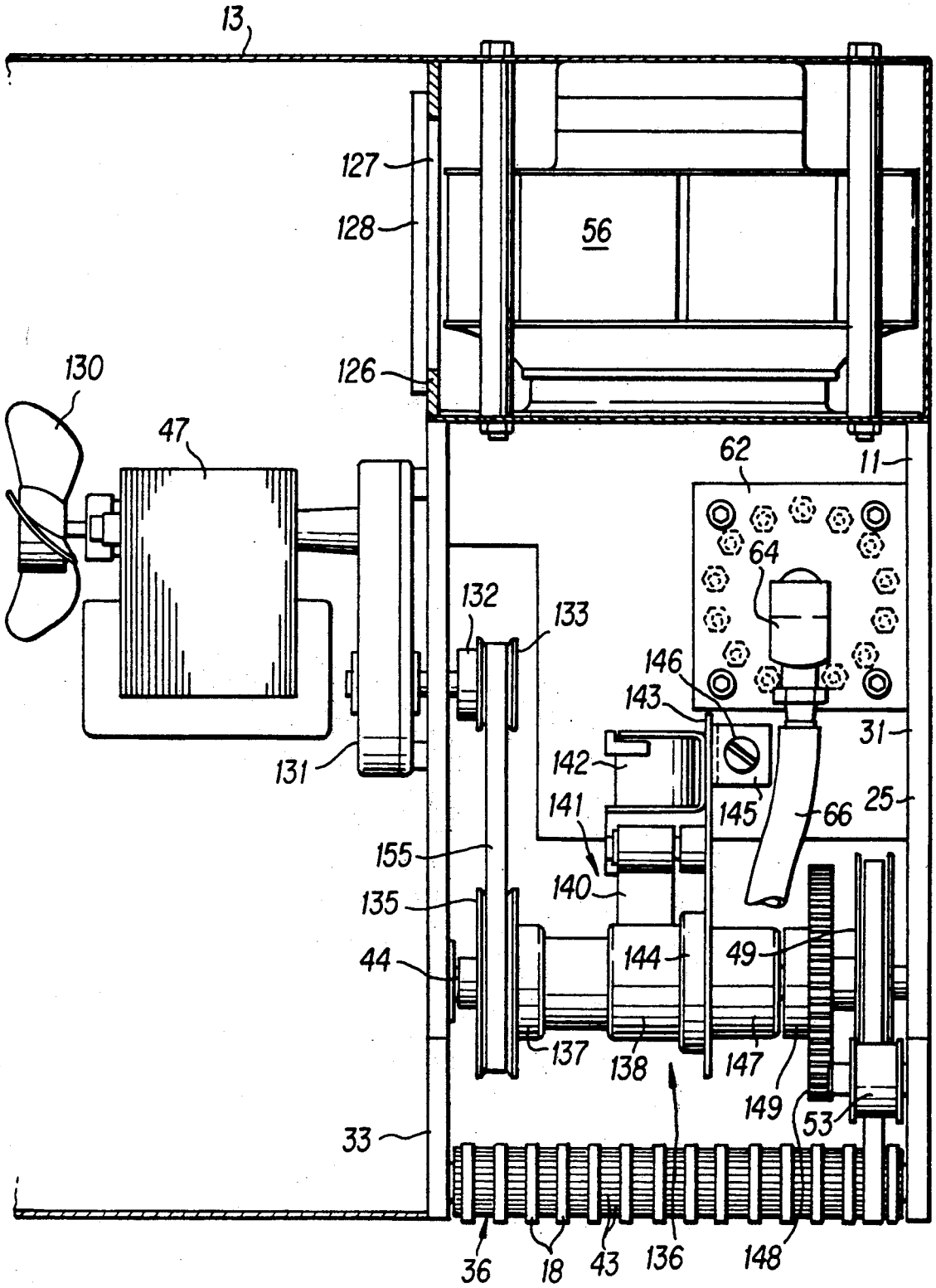
FIG. 7 is a rear view of the label applicator, illustrating the drive system.
Figure 8:
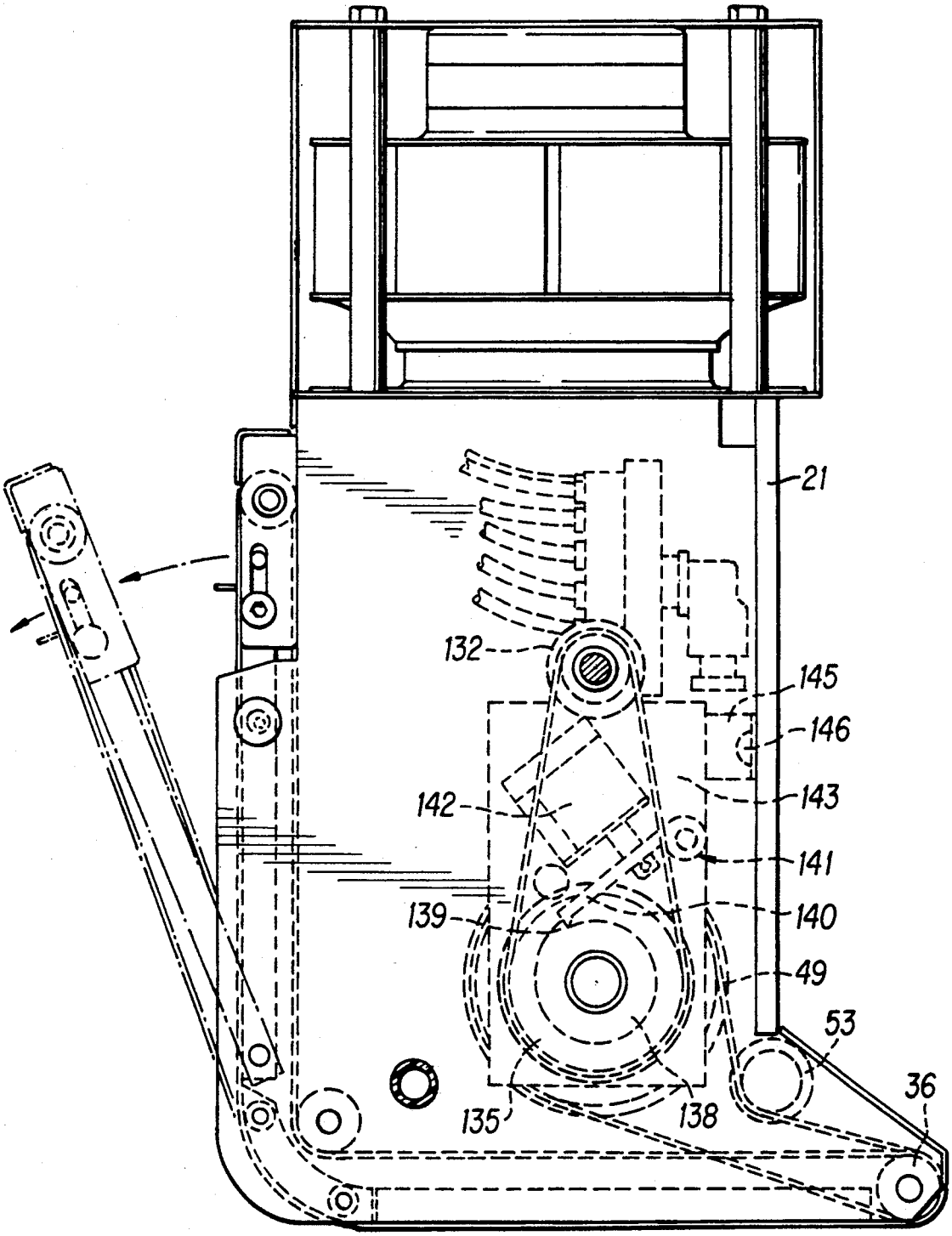
FIG. 8 is a side view of the applicator module, with internal components shown in phantom.

FIGS. 7 and 8 illustrate the details of the drive system used to advance the transport belts 18. A motor 47, housed in the control module 13, provides the power to drive the belts 18. Preferably, the motor 47 is a small, continuously running, alternating current motor, such as a Model CMA motor, manufactured by Rex Engineering Corp. of Miami, Fla., that runs at 100 rpm with a starting torque of 13.8 in/lb. fan 130 provides cooling for the motor 47. Additional cooling is provided by the exhaust fan 56 of the applicator module 11. Cut in a wall 126 separating a top section of the applicator module 11 that encloses the exhaust fan 56 and the control module 13, is an opening 127 that allows a portion of the air evacuated from the chamber 25 by the exhaust fan 56 to be delivered to the interior of the control module 13 for cooling. A guard and filter assembly 128 may be inserted into the opening 127 to prevent particles and objects from entering the control module 13. The control module 13 is provided with a guarded outlet 129 (FIG. 4) in order to allow the air drawn into the control module 13, through the opening 127, to exit.

Coupled to the motor 47 is a gear box 131 which transmits the power from the motor to a short drive shaft 132 which extends through the sidewall 33 of the applicator module housing 25. The drive shaft 132 drives an upper timing belt pulley 133. The rotation of the upper timing belt pulley 133 is transmitted to a lower timing belt pulley 135 by a timing belt 155. The lower timing belt pulley 135 is coupled to the drive shaft 44 which extends across the width of the interior chamber 28 and is connected to the side walls 31 and 33 through conventional bearings which allow the drive shaft 44 to rotate freely.

Attached to the lower timing belt pulley 135 is a conventional, single-revolution wrap spring clutch assembly 136. In the embodiment shown in FIG. 7, the clutch assembly 136 is a CB-4 Model S clutch manufactured by Warner Electric, P.S.I. Division, Pitman, N.J. The assembly 136 includes an input hub 137 which is fixed to the timing belt pulley 135. Coupled to the input hub 137 is a control collar 138 which houses the drive and brake springs (not shown).

With reference to FIG. 8, the collar 138 includes a cam 139 which is engaged by a lever 140 of an actuator assembly 141. The actuator assembly 141 is powered by a solenoid 142 which is intermittently activated to cause the lever 140 to move into and out of engagement with the cam 139 of the collar 138. The solenoid 142 is rigidly attached to a clutch plate 143. Likewise, the brake hub 144 of the clutch assembly 136 is rigidly mounted to the clutch plate 143. The clutch plate 143 is secured to the rear wall 21 by a bracket 145 and bolt 146. The clutch plate 143 and bracket 145 prevent the solenoid 142 and actuator assembly 141 from rotating about the drive shaft 44 when the clutch is engaged, yet also allow limited lateral movement to compensate for any misalignment between the lever 140 and cam 139.

Positioned on the opposite side of the clutch plate 143 from the brake hub 144 is the anti-back hub 147 of the clutch assembly 136. A flywheel 148 having a hub 149 is attached to the drive shaft 44 to provide additional inertia during wrap-down of the clutch assembly 136. Wrap-down occurs when the clutch assembly is activated so that the inner brake spring (not shown) tightly grasps the drive shaft 44 to stop its rotation. Without the inertia produced by the flywheel 148, the clutch brake spring cannot as tightly grasp the drive shaft 44. Consequently, stopping of the drive shaft is not smooth and definitive and start-up of the drive shaft is not consistent. The flywheel 148, however, provides the needed inertia to cause the clutch brake spring to consistently and tightly grasp the drive shaft to bring the drive shaft to a complete stop quickly. Start-up of the drive shaft 44 is also, therefore, both smoother and more predictable and occurs with substantially no slippage. By intermittently activating the clutch assembly 136, the transport belts 18 are advanced in predetermined increments, whereby the location of the labels on the belts 18 can be controlled fairly precisely.

The control module 13 houses the electronic components for controlling the timing and advancement of the belts 18. These components comprise conventional circuitry for relaying control signals and include a microprocessor board 54 (FIG. 4) mounted to the back wall of the control module 13. The microprocessor board 54 is operatively coupled to the motor 47, clutch assembly 35, valve 72, and printer 20 by suitable wiring (not shown for clarity). The operation of the label applicator 10 is discussed further below with reference to FIGS. 17–19.

Figure 9:
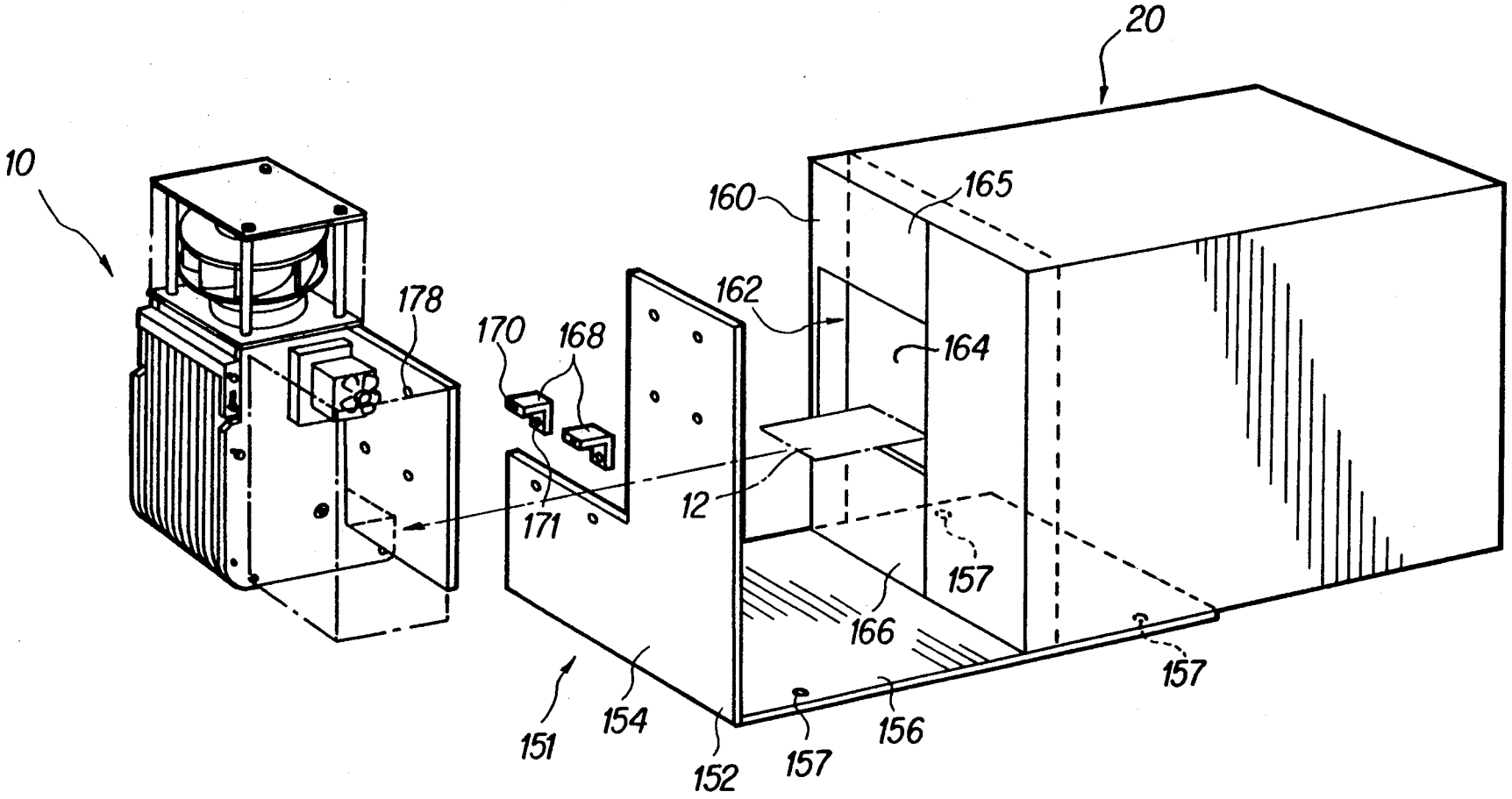
FIG. 9 is an exploded perspective view of an arrangement for mounting the label applicator to a printer.
Figure 10:
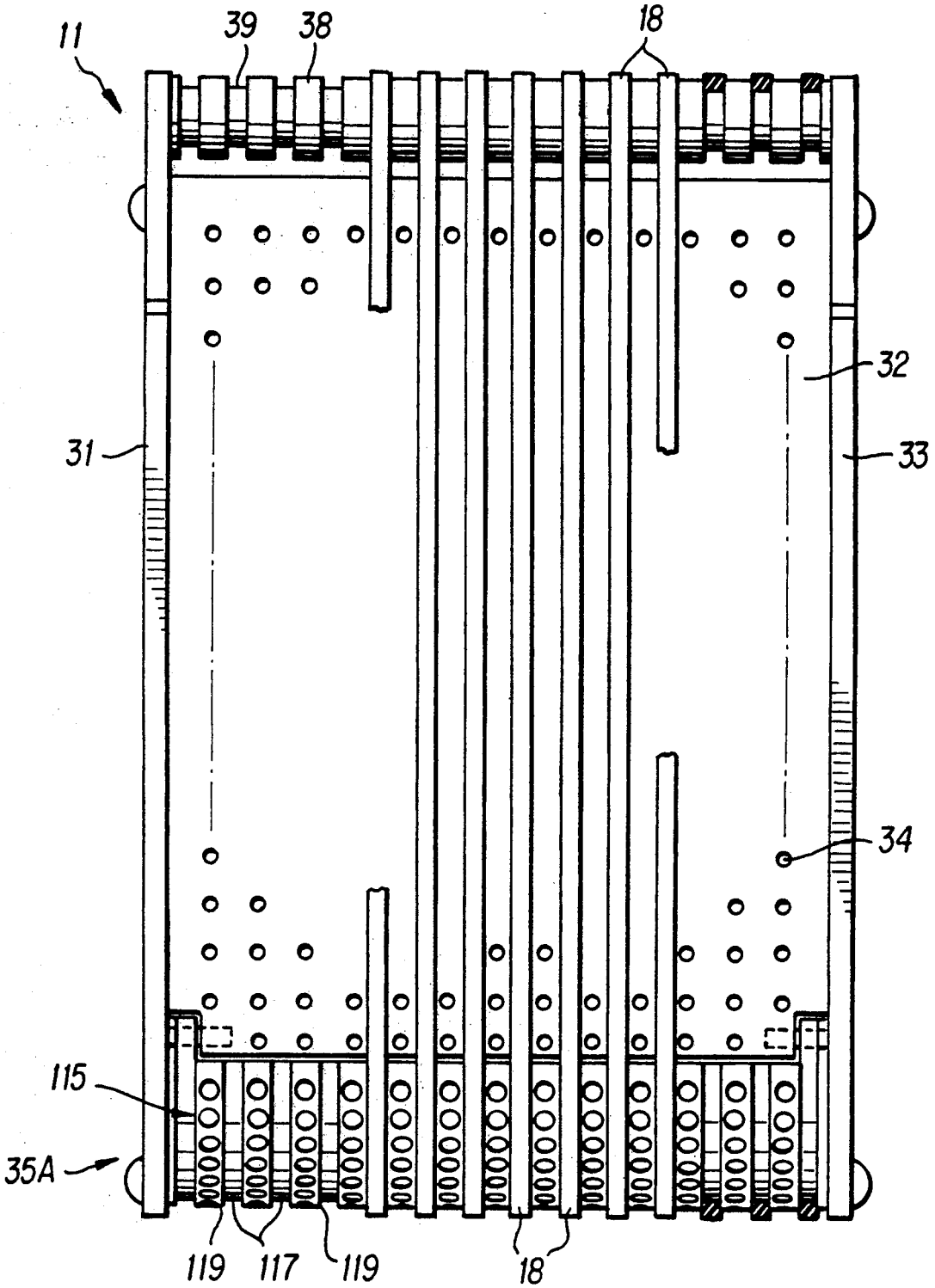
FIG. 10 is a partial front view of a second embodiment of the applicator module showing a second embodiment of the corner assembly.

With reference to FIG. 9, a preferred embodiment of a mounting assembly 151 for mounting the label applicator 10 to the printer 20 is shown. The mounting assembly 150 includes a mounting plate 152 formed from a bottom plate member 156 and an upright plate member 154 which substantially forms a right angle with the member 156. When mounting the applicator 10 to the printer 20, the bottom member 156 is removably bolted to the bottom of the printer 20 at mounting points 157 with the upright member 154 positioned adjacent to the front 160 of the printer 20 and slightly spaced apart therefrom. The printer 20 shown in FIG. 9 has a recessed area 162 with a back wall 164 from which the label 12 is dispensed in a horizontal plane. The recessed area 162 is partially blocked by forward walls 165 and 166.

Brackets 168 are provided for attaching the upright member 154 to the forward wall 166 of the printer 20. The brackets 168 have an L-shape with the longer leg of the "L" having a bolt receiving bore 170 at one end thereof and the shorter leg having a bolt receiving bore hole 171 as shown. With reference to FIG. 2, wherein the applicator 10 is shown mounted to the printer 20, removable bolts 173 and 174 are provided for fastening the brackets 168 to both the forward wall 166 of the printer 20 and the upright member 154 of the mounting plate 152. The upright member 154 may also be removably bolted to the rear wall of the applicator 10. The rear wall is provided with holes 178 which correspond with holes 180 provided on the upright member 154 of the mounting plate 152. With reference to FIG. 2, removable bolts 182 are provided for connecting the two plates 158 and 154. With this mounting arrangement, the applicator 10 can be mounted to the printer 20 and easily removed therefrom by removing the bolts 173, 174, 178, and 180.

FIGS. 10 through 16 illustrate a second embodiment of the invention. This embodiment is similar to the first embodiment described above with reference to FIGS. 3–9, with the major differences being a modification of the corner assembly of the applicator module 11 and the placement of a majority of the drive system components within the control module 13. Components of the second embodiment that are the same as corresponding components of the first embodiment have been given the same reference numerals, whereas like components that have been modified in the second embodiment have the letter "A" added to the reference numeral.

The corner assembly 35A of the second embodiment comprises a corner piece 115 which is provided with a plurality of substantially parallel, spaced-apart belt grooves 117 in which the transport belts 18 are seated. The grooves 117 preferably have a thickness less than the thickness of the belts 18. The corner piece 115 curves through an arc such that the ends 118 of the grooves 117 extend in planes that are tangent to respective outer surfaces of the faceplates 30 and 32. The grooves 117 assist in guiding the belts 18 as they advance around the corner assembly 35A and prevent the belts from slipping out of alignment.

Figure 11:
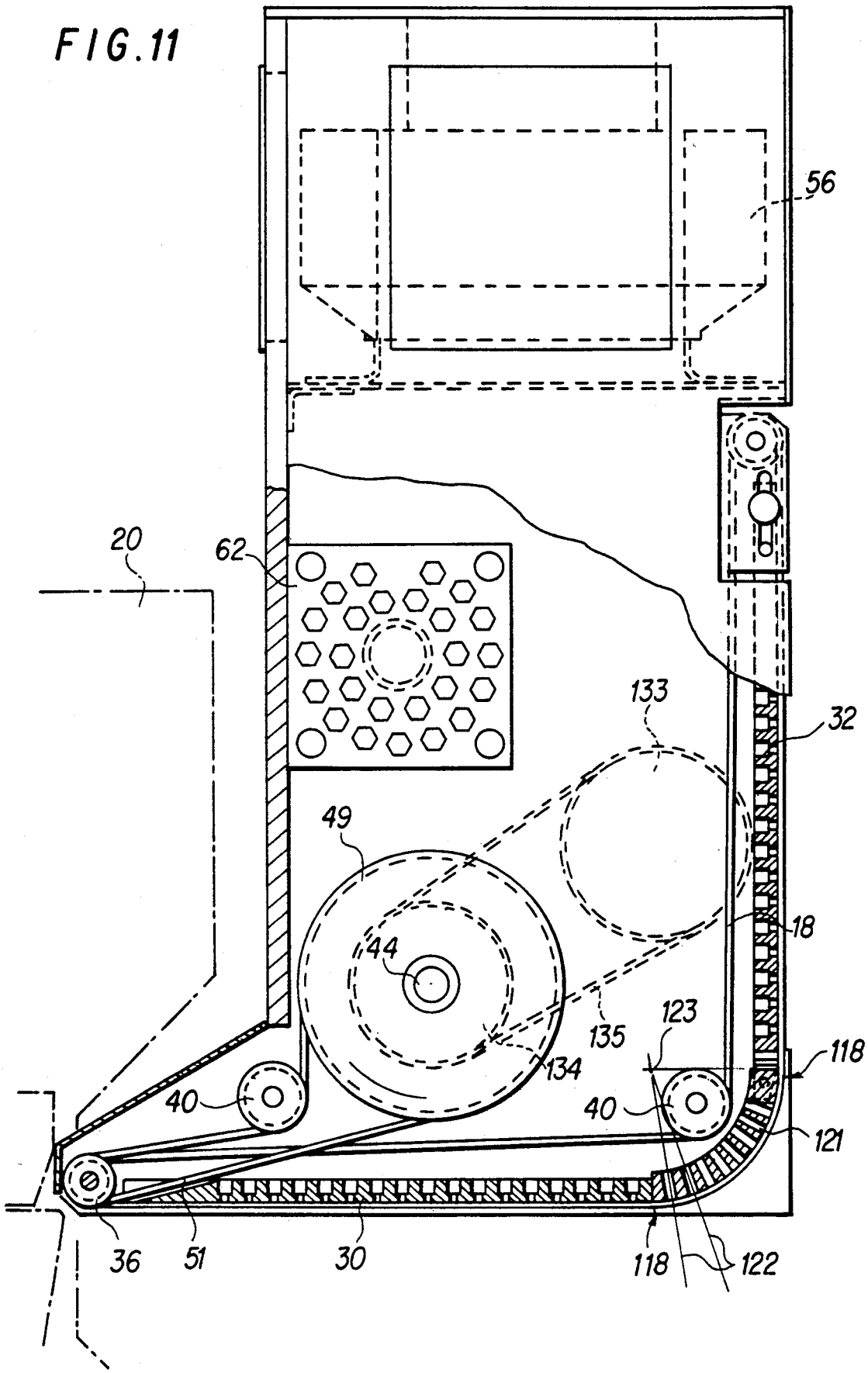
FIG. 11 is a side cross-sectional view of the applicator module according to the second embodiment of the invention.

Formed between the grooves 117 are a plurality of ridges 119. A series of holes 121, provided in the ridges 119, communicate between the interior chamber 28 of the housing 25 and the outside. As shown in FIG. 11, the holes 121 have a substantially uniform diameter throughout, with their longitudinal center lines 122 preferably intersecting the focus 123 of the arc line of the corner piece 115. As with the corner pieces 108 of the first embodiment, the corner piece 115 may be made from a plastic material or Teflon-coated metal. In addition, the holes 121 preferably are of a larger dimension than the holes 34 of the faceplates 30 and 32 so that the labels 12 are exposed to the partial vacuum created in the chamber 25 over a greater area.

Figure 12A:
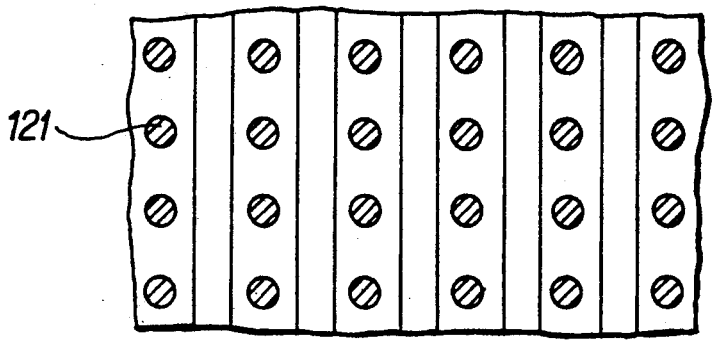
FIGS. 12A and 12B illustrate front elevational and cross-sectional views, respectively, of the corner assembly of the second embodiment of the invention, wherein the conveyor belts have a thickness equal to the depth of the grooves of the corner assembly.
Figure 12B:
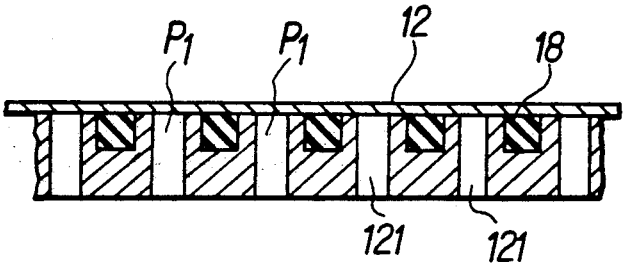
Figure 13A:
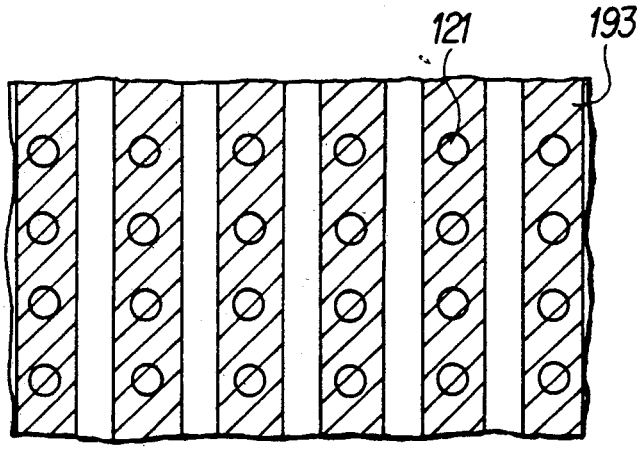
FIGS. 13A and 13B illustrate preferred, front elevational and cross-sectional views, respectively, of the corner assembly of the second embodiment of the invention, wherein the conveyor belts are thicker than the depth of the corner assembly grooves.
Figure 13B:
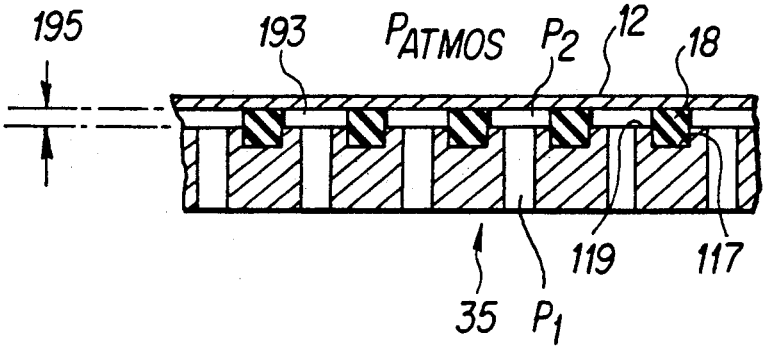

As mentioned above, the grooves 117 of the corner assembly 35A are preferably shallower than the thickness of the belts 19. This arrangement allows the formation of chambers between the labels and the corner piece 115 that have a reduced pressure $P_2$. As shown in FIGS. 12A and 12B, if the grooves 117 and belts 18 have the same dimensions, no chambers of reduced pressure are formed. As a result, the label 12 will be directly exposed to the reduced pressure $P_1$ that is created in the chamber 25 of the applicator module. However, the labels 12 will only be exposed to the pressure $P_1$ over a limited area equal to the size of the holes 121. This area is represented by the cross-hatching in FIG. 12A. If, however, the grooves 117 have a depth less than the belt thickness as shown in FIGS. 13A and 13B, a gap 195 is formed between the label 12 and the exterior surfaces of the ridges 119 when the belts 18 are seated in the grooves 117 and a label 12 is carried by the belts 118. By spacing the label 12 away from the corner assembly 35A in this manner, chambers 193 are formed that have a reduced pressure $P_2$ which is slightly higher than $P_1$. As shown in FIG. 13A, these chambers 193 (shown by cross-hatching) cover a much larger area than the holes 121 themselves. Accordingly, the labels 12 are continuously exposed to an effectively greater retaining force as they traverse the corner assembly 35A.

Figure 14:
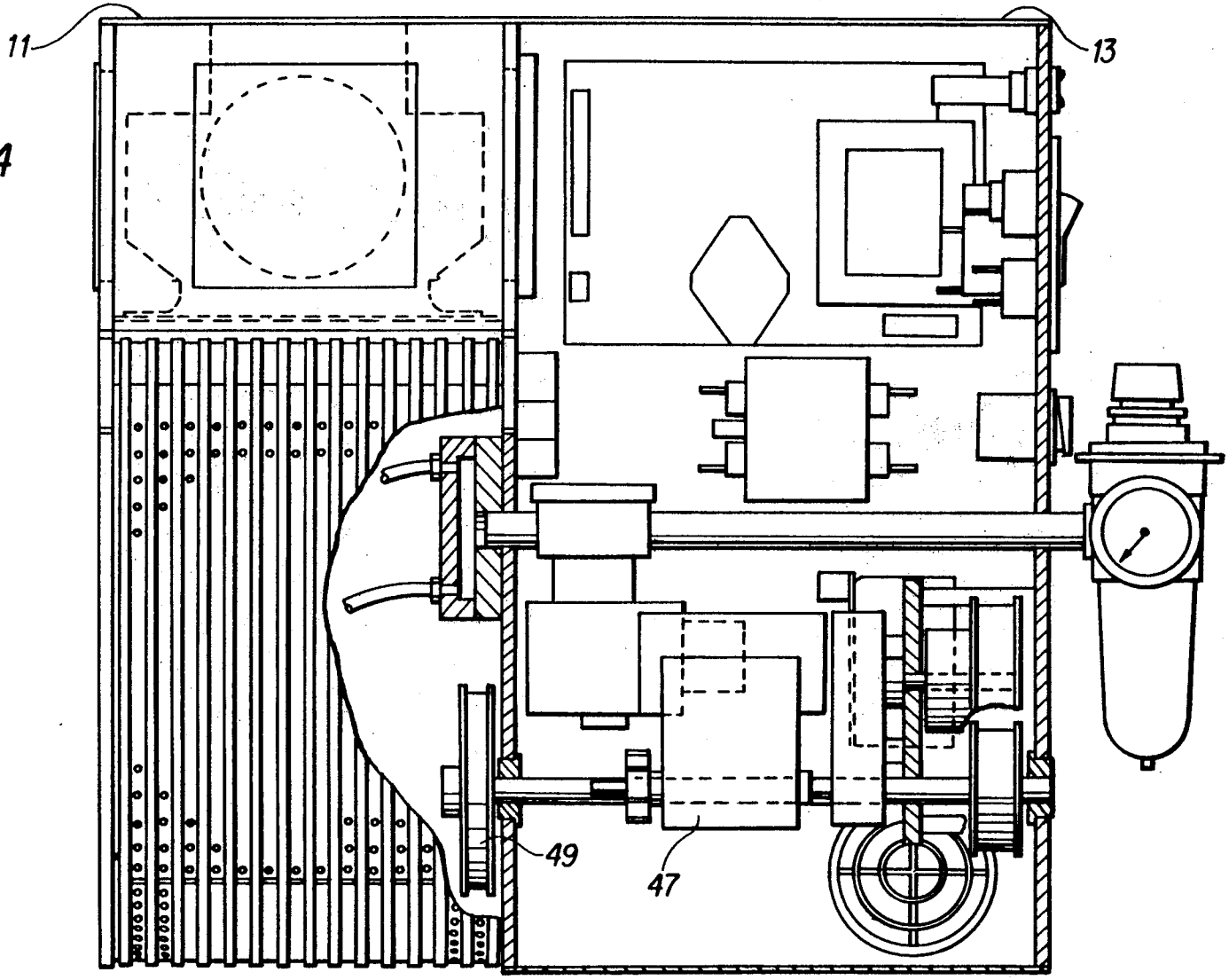
FIG. 14 is a front view of the applicator module and control module used in the second embodiment of the label applicator.

With reference to FIGS. 11 and 14–16, the particular components of the drive system used in the second embodiment in order to drive the transport belts 18 are essentially identical to those used for the drive system of the first embodiment described above; however, a majority of these components are housed in the control module 13 as opposed to the applicator module 11. As shown in FIG. 11, only the drive pulley 36, timing belt pulley 49, timing belt 51, and idler 40 of the drive system are housed in the applicator module 11. As with the first embodiment, the timing belt pulley 49 is fixed to the drive shaft 44 that is further coupled to the motor 47. As shown in FIG. 14, the motor 47 and the remaining drive train components are enclosed in the control module 13.

Figure 15:
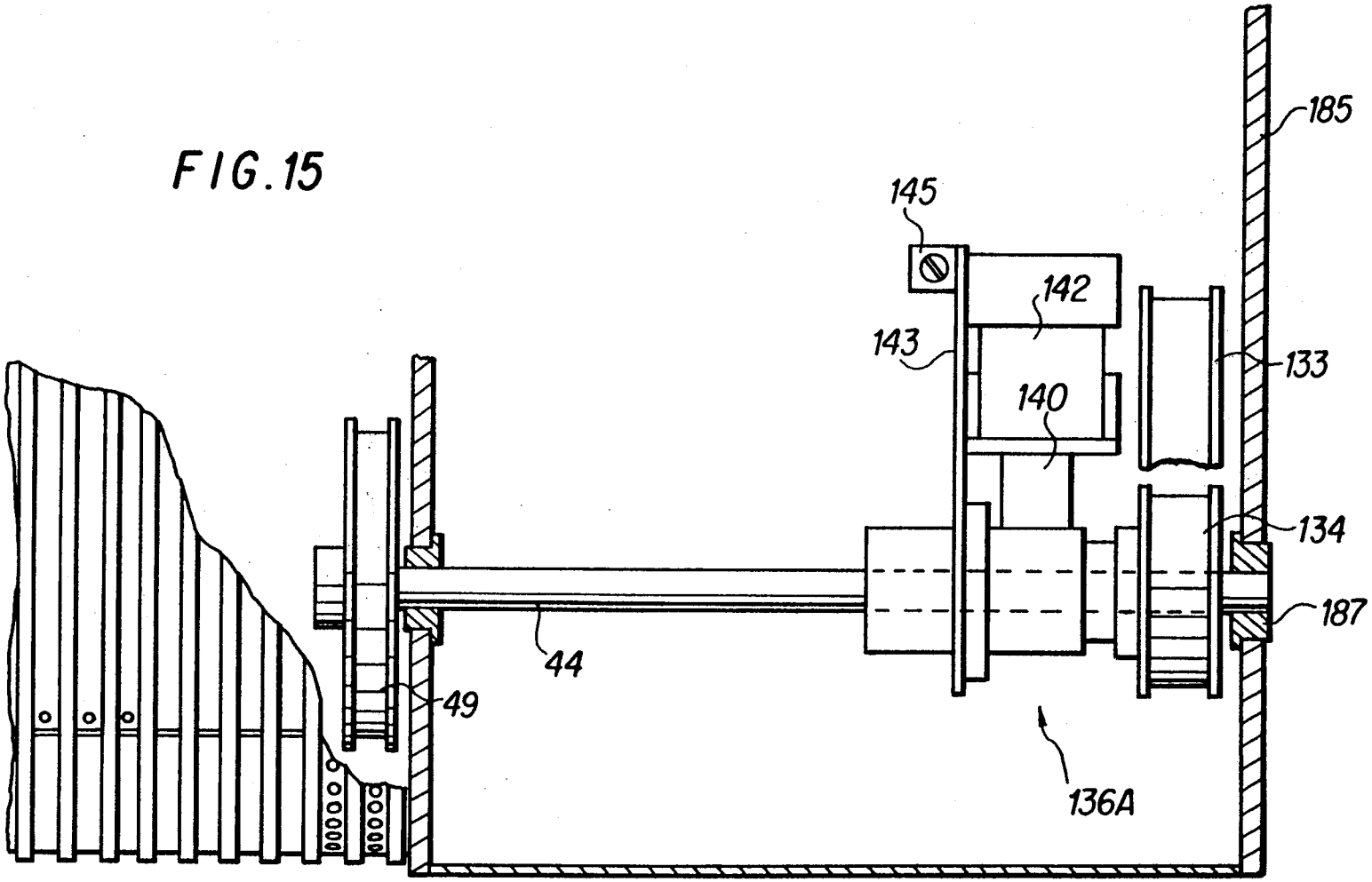
FIG. 15 is a fragmentary front view of a first portion of the drive system used in the second embodiment of the label applicator.
Figure 16:
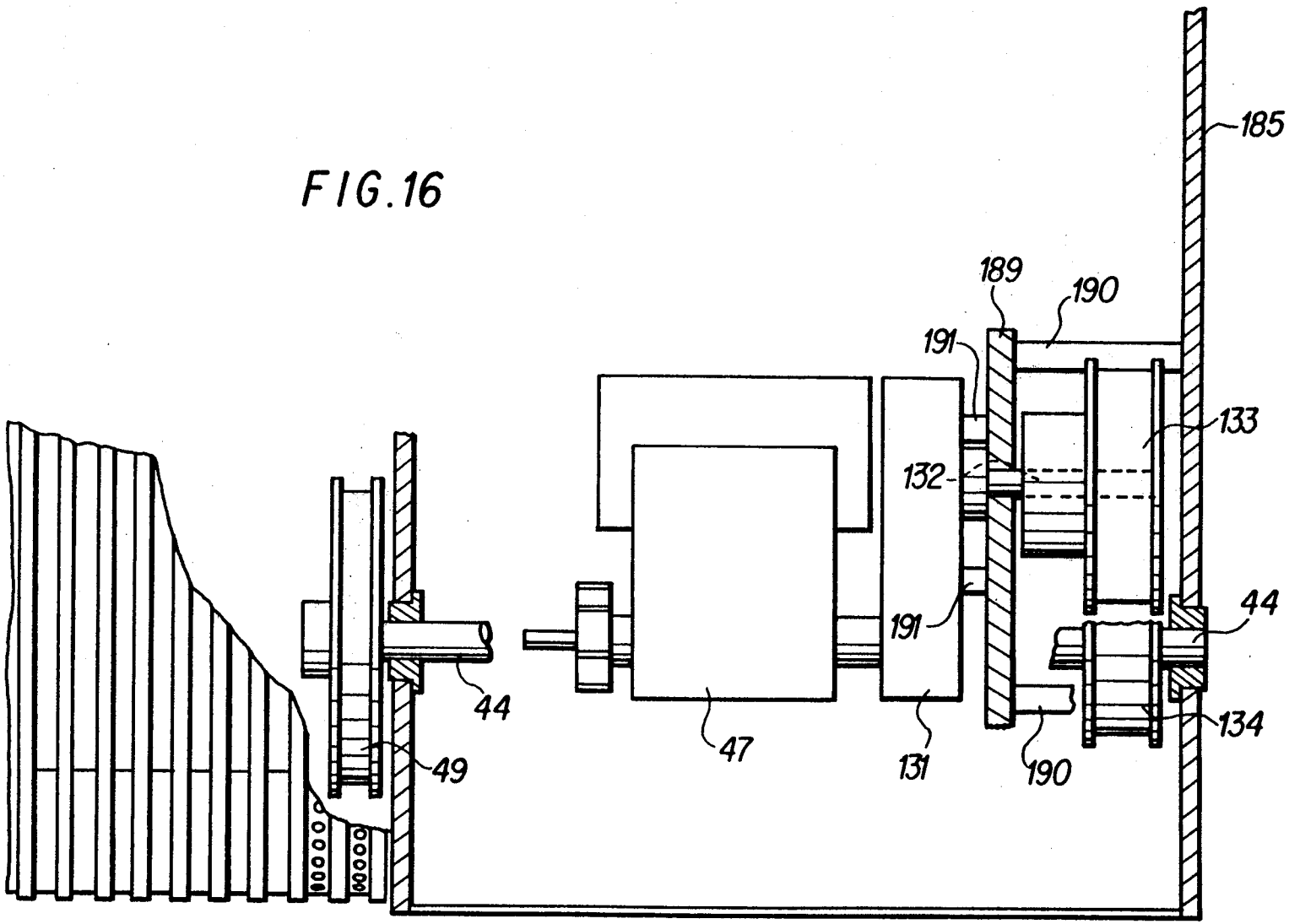
FIG. 16 is a fragmentary front view of a second portion of the drive system used in the second embodiment of the label applicator.

For clarity, the drive train is illustrated in two separate sections in FIGS. 15 and 16. FIG. 15 shows a first section of the drive train extending from the timing belt pulley 49 of the applicator module 11 and across the back of the control module 13 to the lower timing belt pulley 134. The drive shaft 44 extends across the width of the control module 13 and is connected to a side wall 185 of the control module 13 through a conventional bearing 187. The lower timing belt pulley 134 is coupled to the drive shaft 44. Attached to the lower timing belt pulley 134 is a conventional single-revolution wrap spring clutch assembly 136A, similar to the clutch assembly 136 of the first embodiment. The clutch assembly 136A is mounted to clutch the plate 143, which in turn is attached to the back wall of the control module 13 by the bracket 145.

The lower timing belt pulley 134 is coupled to the upper timing belt pulley 133 by the timing belt 135. As shown in phantom in FIG. 11, the upper timing belt pulley 133 is positioned above and forward of the lower timing belt pulley 134. FIG. 16 shows the second section of the drive train that extends from the upper timing belt pulley 133 and across the front of the control module 13. As shown, the upper timing belt pulley 133 is drivingly coupled to drive shaft 132. The drive shaft 132 extends through a mounting plate 189 to the gear box 131 which transmits power from the motor 47 to the drive shaft 132. The gear box 131 is mounted to the mounting plate 189, which in turn is affixed to the side wall 185 by mounting supports 190. The drive system of the second embodiment operates in the same manner as the drive system of the first embodiment in order to advance the transport belt 18.

Figure 17:
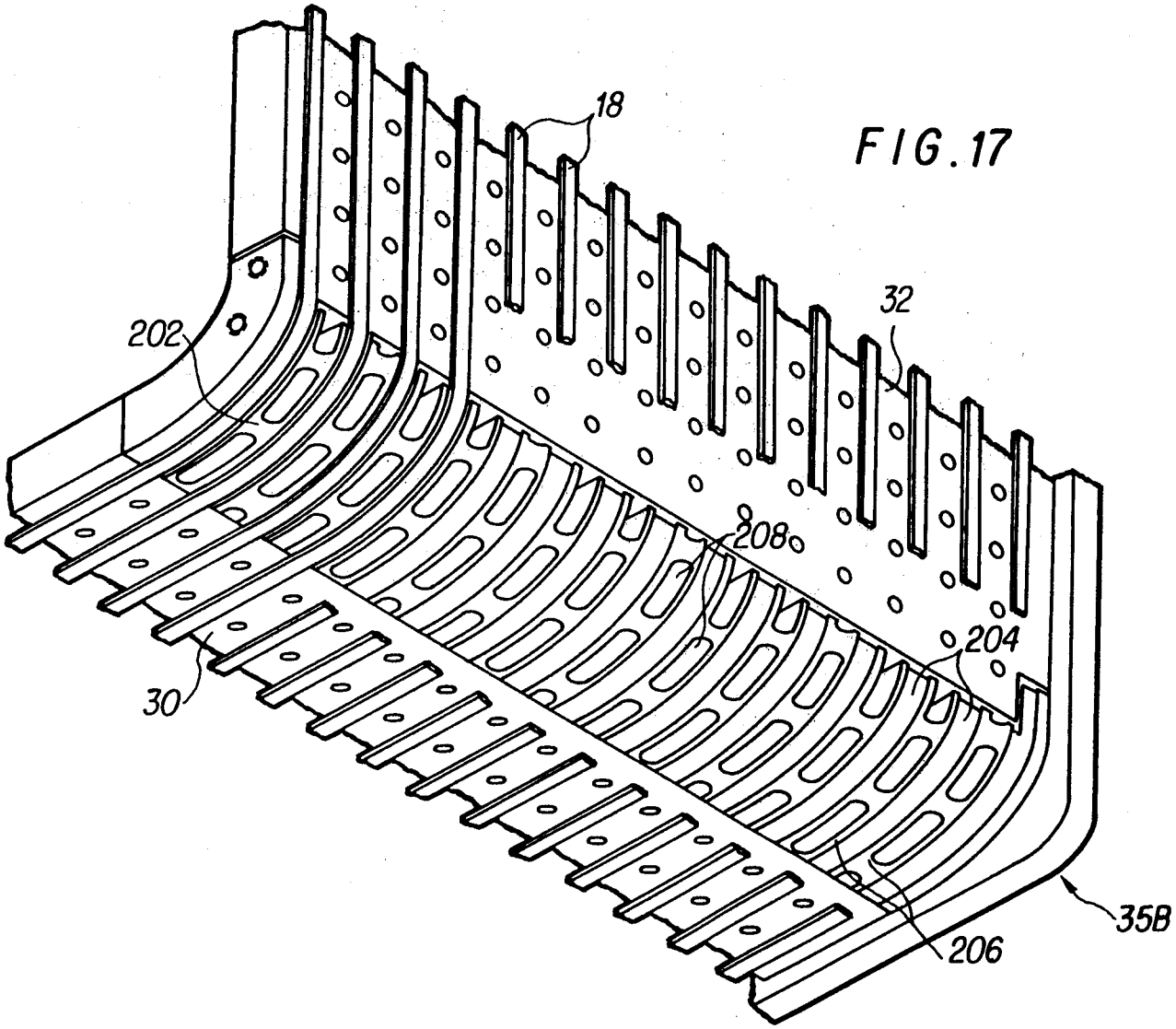
FIG. 17 is an enlarged perspective view of a third embodiment of the corner assembly of the present invention.

With reference to FIG. 17, a third embodiment of the corner assembly is illustrated. The corner assembly 35B comprises an arcuate corner piece 202 that is provided with a plurality of substantially parallel, spaced-apart belt grooves 204 in which the transport belts 18 may sit. The grooves 204, like the grooves 117 of the second embodiment of the corner assembly (FIG. 10), preferably have a thickness less than the thickness of the belts 18. Formed between the grooves 204 are ridges 206. A series of elongated openings 208 are provided in the ridges to 206 in order to communicate the interior chamber with the outside.

The third embodiment shown in FIG. 17 essentially represents a compromise between the first and second embodiments of the corner assembly. The openings 208 provide greater exposure of the label to the suction than the holes 121 of the second embodiment. However, with the arrangement of FIG. 17 only a single corner piece 202 need be formed rather than a series of corner segments 102 as with the first embodiment.

Figure 18:
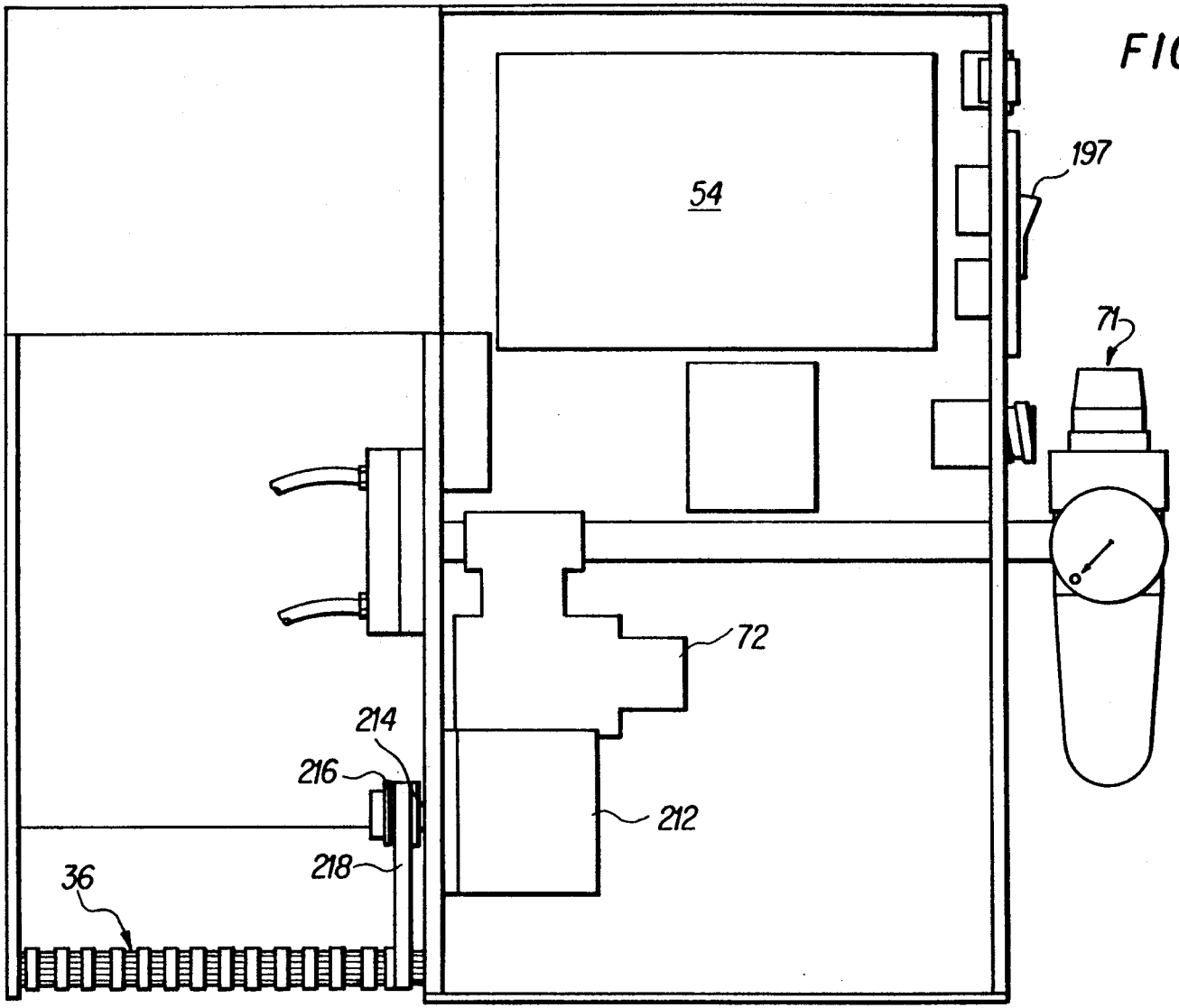
FIG. 18 is a front view of a third embodiment of the drive system of the label applicator.

FIG. 18 illustrates an alternative to the use of a motor and clutch assembly arrangement in order to drive and advance the transport belts 18. In this embodiment, the motor 47 and clutch assembly 136 is replaced with a stepper motor 212. The stepper motor 212 may be a VEXTA PH268-E1.6 model motor manufactured by Oriental Motor USA Corporation. The stepper motor is operatively coupled to a drive shaft 214. The drive shaft 214 drives a timing belt pulley 216. The rotation of the timing belt pulley 216 is transmitted to the drive pulley 36 by a timing belt 218.

Figure 19:
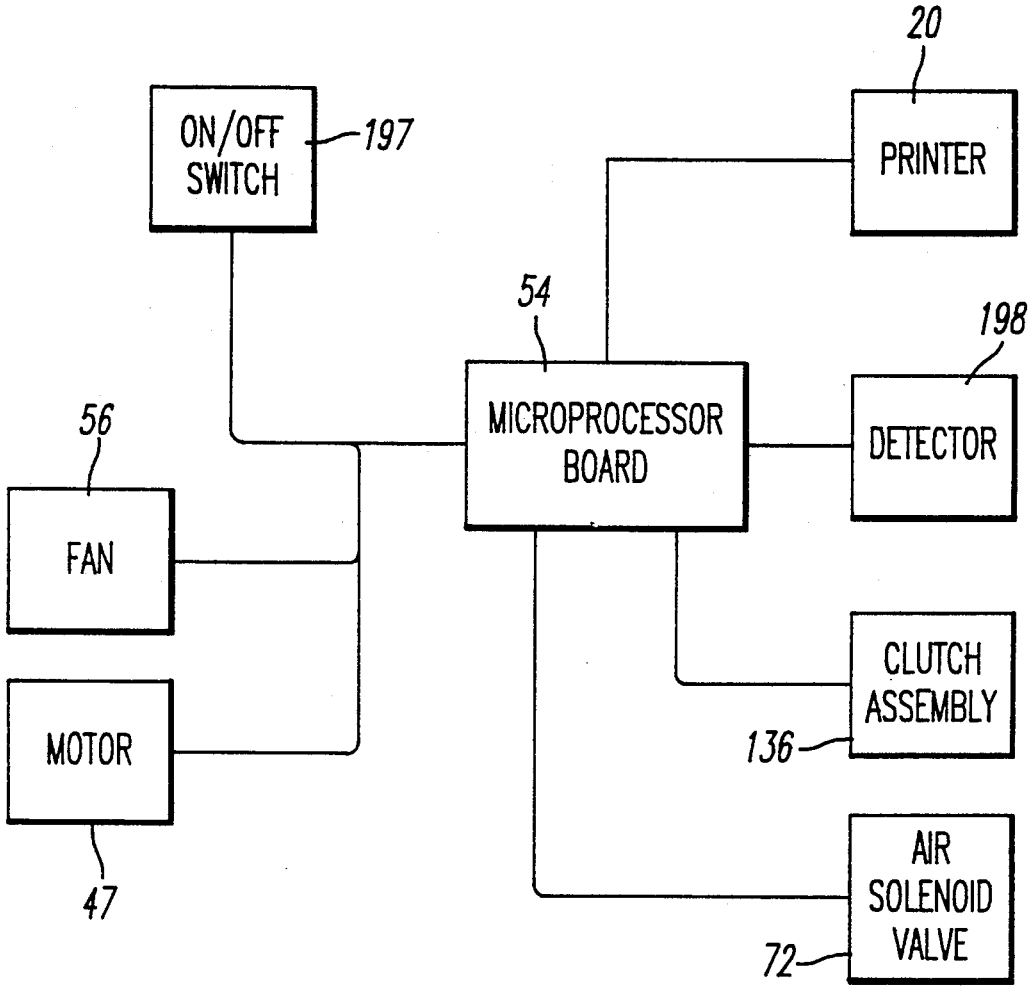
FIG. 19 is a block diagram of an exemplary control circuit for the label applicator of the present invention.

The preferred modes of operating the label applicator 10 will now be described with reference to FIGS. 1 and 19 through 21. FIG. 19, in particular, illustrates a block diagram of the control system of the label applicator, which is the same for the various embodiments of the applicator. The control system includes a microprocessor board 54 which interfaces with the various components of the label applicator as well as with the printer 20. The circuit board 54 may be wired to control the operation of the components in one of two preferred modes of operation. The first mode is illustrated by the flow chart of FIG. 20. This first mode is a queue mode which allows the printer 20 to produce a first label, and while the applicator transports this first label to a label applying position, a second label is printed and fed to the applicator. This second label is held in a queue until the first label is applied to the article or box, at which time the second label is then transported to the label applying position. The second mode of operation of the applicator, as illustrated by the flow chart of FIG. 21, is a no-queue mode whereby a label is printed, transported and applied before a second label is printed.

Figure 20:
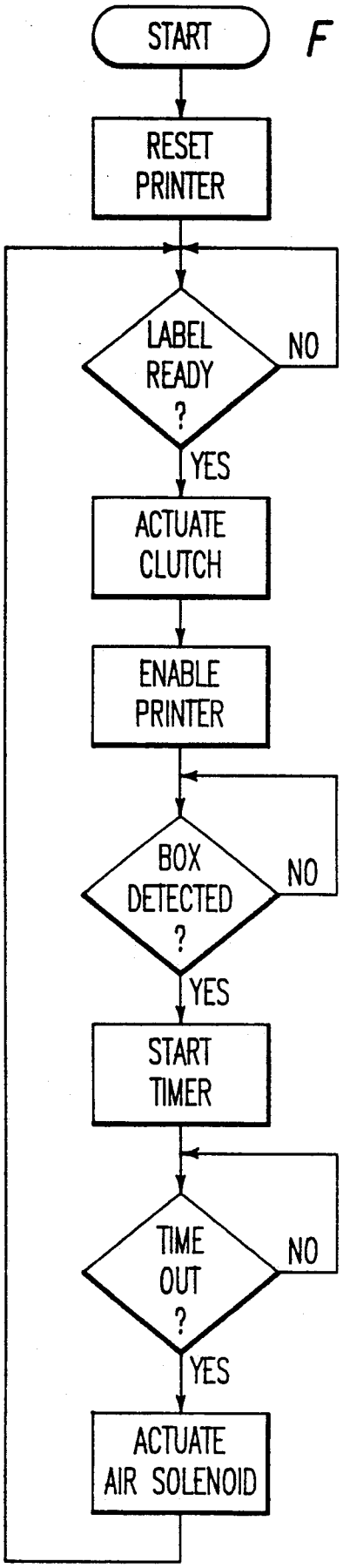
FIG. 20 is a flow chart illustrating a first mode of operation of the label applicator.
Figure 21:
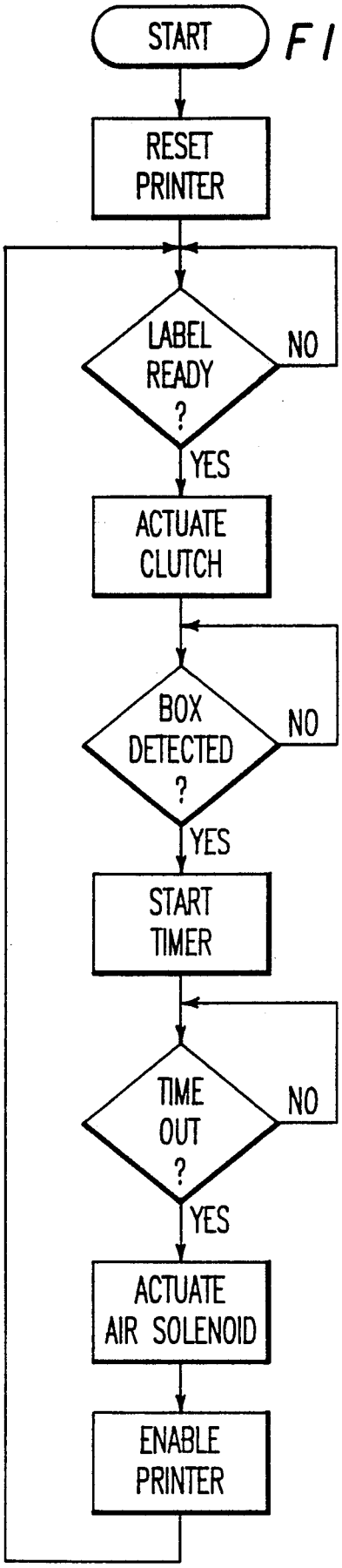
FIG. 21 is a flow chart illustrating a second mode of operation of the label applicator

With reference to FIG. 20, operation of the first mode is initiated by engaging an on-off switch 197 which causes the fan 56 to start up, thereby creating a partial vacuum in the chamber 28 of the applicator module. While the partial vacuum is being initiated, the printer is automatically reset and instructed to print a label. During this printing step motor 47 is started up and the clutch assembly is held in engagement with the drive shaft 44 so that the belts 18 are held stationary. If a stepper motor is employed, it is held in an inactive state during the printing step so that the belts remain stationary.

The belts are held stationary until a label is ready, that is, until printing is completed and the label has been fed to the first face plate of the label applicator. Once label printing is completed, the clutch is actuated, allowing the shaft 44 to move through one revolution and advance the belts 18 so that the label is transported around the corner assembly and into a label-applying position on the second, vertical face plate. Once the clutch has moved through one rotation, it returns to its engaged position whereby the belts 18 are held stationary. If a stepper motor is used, at this point it is activated in order to rotate the shaft 44. The stepper motor is activated for a predetermined time to allow the label to be transported around the corner assembly and into the label-applying position. Activation of the stepper motor may coincide with detection of a box as described further below.

Next, the printer is enabled in order to place another label in the queue by printing and feeding the label to the applicator. The labels are held in their respective queue positions until a detector 198 (see FIG. 1) is triggered by the passage of an article or box 15 and a predetermined period of time has expired. The detector 198 is preferably a photoelectric sensor that detects the passage of the box 15. When the sensor 198 is triggered, a timer is started. The length of time for which the timer is set is determined by the time needed for the box to be conveyed from the point at which it is detected by the sensor 198 to a point in which it is aligned with the applicator module 11. When this time period has expired, the solenoid air valve 72 is actuated and a burst of pressurized gas is applied to selected holes of the vertical face plate, causing the label held thereon to be applied to the article 15. After the solenoid valve is actuated, the system begins the process once again by actuating the clutch so that the label being held in queue on the horizontal face plate is transported around the corner assembly and onto the vertical face plate.

The no-queue mode illustrated by the flow chart of FIG. 21 is similar to the queue mode of FIG. 20 except that the printer does not queue labels to the applicator. After the system has been initiated and a printed label is fed to the label applicator, the clutch is actuated (or the stepper motor) so that the label is moved from the horizontal face plate to the vertical face plate. The label is held in the vertical position until a box has been detected by the sensor 198 and the predetermined time has expired, after which the solenoid air valve is actuated in order to apply the label to the article. Once the label has been applied, the printer is enabled and another label is printed and fed to the label applicator for application to the next article.

Although the present invention has been described with reference to preferred embodiments, the invention is not limited to the details thereof. For example, although the label applicator described herein conveys a label through an approximately 90° turn, the face plates of the applicator can be positioned such that the angle formed therebetween is more or less than 90°. Other substitutions and modifications will occur to those of ordinary skill in the art, and all such substitutions and modifications are intended to fall within the scope of the invention as defined in the appended claims.

What is claimed is:

1. A label applicator for applying labels to articles, comprising:

a housing defining an interior chamber adapted to be connected to a source of reduced pressure such that a partial vacuum is maintained in said chamber, said housing comprising:

a first sidewall for receiving labels to be applied to an article, said first sidewall including a first faceplate having a plurality of holes passing therethrough, said holes each forming a passage connecting the chamber to the exterior of said housing, a second sidewall for receiving labels from said first sidewall and applying the labels to the article, said second sidewall including a second faceplate having a plurality of holes passing therethrough, said holes each forming a passage connecting the chamber to the exterior of said housing; and a corner member disposed between said first and second faceplates, said corner member including stationary portion having at least one opening forming a passage connecting the chamber to the exterior of said housing; and at least one conveyor belt, carried by said housing, for conveying labels from said first faceplate to said second faceplate, said conveyor belt extending across the exterior surfaces of the first faceplate, the corner member and the second faceplate;

wherein said first and second faceplates are positioned adjacent to each other such that each faceplate extends in a different plane.

2. The label applicator of claim 1, wherein said at least one opening defined by the stationary portion of said corner member is larger than the holes of said first and second sidewall means.

3. The label applicator of claim 1, wherein said stationary portion of said corner member comprises a plurality of fixed, spaced-apart arcuate members, and wherein a plurality of openings are formed by the spaces between said arcuate members, said openings each forming a passage connecting the chamber and the exterior of said housing.

4. The label applicator of claim 1, wherein said corner member comprises a fixed arcuate member provided with a plurality of rows of openings, said opening each forming a passage connecting the chamber and the exterior of said housing.

5. The label applicator of claim 1, wherein said conveyor belts comprises a timing belt.

6. The label applicator of claim 1, wherein said conveyor belt comprises one of a plurality of substantially parallel endless belts extending across the exterior surfaces of the first faceplate, the corner member and the second faceplate.

7. The label applicator of claim 1, further comprising a power source coupled to said conveyor belt for driving said belt.

8. The label applicator of claim 7, wherein said power source comprises a motor and a clutch assembly coupled to said motor for producing intermittent movement of said conveyor belt.

9. The label applicator of claim 7, wherein said power source is substantially enclosed in said housing.

10. The label applicator of claim 7, further comprising a control module, coupled to said housing, for controlling the receipt and application of labels by the applicator, said control module enclosing a substantial portion of said power source.

11. The label applicator of claim 1, wherein said first faceplate extends in a plane substantially perpendicular to the plane of said second faceplate.

12. The label applicator of claim 1, further comprising a label propelling device coupled to said second faceplate for propelling a label carried by said conveyor belt across said second faceplate away from said applicator and onto an article.

13. The label applicator of claim 1, wherein said label propelling device comprises at lease one tube that is coupled to said second faceplate and is adapted to be connected to a source of pressurized gas, such that said tube provides a passage for the pressurized gas to at least one of the holes of said second faceplate.

14. The label applicator of claim 1, further comprising an evacuation device coupled to said housing for evacuating gas from the chamber, thereby creating a partial vacuum in the chamber that causes gas to flow inward though the holes of the first and second faceplates and through the at least one opening defined by said stationary portion of said corner member.

15. A label applicator for applying labels to articles, comprising:

a housing defining an interior chamber adapted to be connected to a source of reduced pressure such that a partial vacuum is maintained in said chamber, said housing comprising:

a first faceplate having a plurality of holes passing therethrough, said holes each forming a passage connecting the chamber to the exterior of said housing, a second faceplate having a plurality of holes passing therethrough, said holes each forming a passage connecting the chamber to the exterior of said housing, and a corner member disposed between the first and second faceplates, said corner member including a stationary portion having at least one opening which forms a passage connecting the chamber and the exterior of the housing;

a conveyor carried by the housing for carrying labels across the exterior surface of the first faceplate, around the corner assembly, and across the exterior surface of the second faceplate; and at least one conduit enclosed in said housing, said conduit having one end adapted to be connected to a source of pressurized gas and the opposite end adapted to be received in one of the holes of the second faceplate;

wherein aid first faceplate extends at an angle with respect to the plane of said second faceplate; and wherein said at least one opening of said stationary portion of said corner member defines an area larger than that defined by the holes of said first and second faceplates for a given label area.

16. The label applicator of claim 15, wherein said conveyor comprises a series of endless belts, each of said belts extending across the exterior surfaces of the first faceplate, the corner member, and the second faceplate.

17. A label conveying apparatus comprising:

first and second faceplates extending in different planes, each of said faceplates having a plurality of holes passing therethrough;

a corner member disposed between said first and second faceplates, said corner member including a stationary portion having at least one opening therein;

at least one conveyor belt extending across said first and second faceplates and said corner member for conveying labels from the first faceplate to the second faceplate; and at least one vacuum source for applying a partial vacuum through the holes in said faceplates and the opening in the stationary portion of said corner member in order to cause labels to adhere to said faceplates and corner member.

18. A label conveying apparatus claimed in claim 17, wherein said stationary portion of said corner member comprises a plurality of fixed, spaced-apart arcuate members forming said at least one opening therebetween.

19. A label conveying apparatus claimed in claim 17, wherein said corner member comprises a fixed arcuate member provided with a plurality of rows of openings.

20. A label conveying apparatus claimed in claim 17, wherein said conveyor belt comprises one of a plurality of substantially parallel endless belts extending across the surfaces of said first and second faceplates and said corner member.

21. A label conveying apparatus claimed in claim 17, further comprising a label propelling device coupled to said second faceplate for propelling a label carried by said conveyor belt away from said second faceplate and onto an article or surface to be labelled.

22. A label conveying apparatus claimed in claim 17, wherein said at least one opening in the stationary portion of said corner member defines an area larger than that defined by the holes in said first and second faceplates for a given label area.

* * * * *